US010961796B2

(12) United States Patent
Slup et al.

(10) Patent No.: US 10,961,796 B2
(45) Date of Patent: Mar. 30, 2021

(54) SETTING TOOL ASSEMBLY

(71) Applicant: The WellBoss Company, LLC, Houston, TX (US)

(72) Inventors: Gabriel Antoniu Slup, Spring, TX (US); Evan Lloyd Davies, Houston, TX (US)

(73) Assignee: The WellBoss Company, LLC, Houston, TX (US)

( * ) Notice: Subject to any disclaimer, the term of this patent is extended or adjusted under 35 U.S.C. 154(b) by 0 days.

(21) Appl. No.: 16/569,362

(22) Filed: Sep. 12, 2019

(65) Prior Publication Data

US 2020/0080394 A1 Mar. 12, 2020

Related U.S. Application Data

(60) Provisional application No. 62/730,124, filed on Sep. 12, 2018, provisional application No. 62/840,586, filed on Apr. 30, 2019.

(51) Int. Cl.
*E21B 23/01* (2006.01)
*E21B 23/06* (2006.01)

(52) U.S. Cl.
CPC ..... *E21B 23/01* (2013.01); *E21B 23/06* (2013.01)

(58) Field of Classification Search
CPC ..... E21B 23/01; E21B 23/06
See application file for complete search history.

(56) References Cited

U.S. PATENT DOCUMENTS

| | | | |
|---|---|---|---|
| 2,230,712 | A | 2/1941 | Bendeler et al. |
| 2,683,492 | A | 7/1954 | Baker |
| 2,797,758 | A | 7/1957 | Showalter |
| 3,163,225 | A | 12/1964 | Perkins |
| 3,343,607 | A | 9/1967 | Current |
| 3,422,898 | A | 1/1969 | Conrad |
| 3,687,196 | A | 8/1972 | Mullins |
| 3,769,127 | A | 10/1973 | Goldsworthy et al. |
| 3,776,561 | A | 12/1973 | Haney |
| 4,359,090 | A | 11/1982 | Luke |
| 4,388,971 | A | 6/1983 | Peterson |
| 4,436,150 | A | 3/1984 | Barker |
| 4,437,516 | A | 3/1984 | Cockrell |
| 4,440,223 | A | 4/1984 | Akkerman |
| 4,469,172 | A | 9/1984 | Clark |
| 4,630,690 | A | 12/1986 | Beasley et al. |
| 4,711,300 | A | 12/1987 | Wardlaw et al. |
| 4,784,226 | A | 11/1988 | Wyatt |

(Continued)

FOREIGN PATENT DOCUMENTS

| | | |
|---|---|---|
| EP | 0136659 | 4/1985 |
| EP | 0504848 | 9/1992 |

(Continued)

*Primary Examiner* — Giovanna Wright
*Assistant Examiner* — Dany E Akakpo
(74) *Attorney, Agent, or Firm* — Rao DeBoer Osterrieder, PLLC; John M. DeBoer

(57) ABSTRACT

A setting tool assembly having an adapter housing configured to couple with a part of a workstring, and an inner housing coupled with the adapter housing. A trigger device is coupled with a movable piston. During run-in, the piston is in a first position. Upon activation, the trigger device undergoes an altering event whereby the piston moves to a second position as a result of a pressure acting thereon.

17 Claims, 10 Drawing Sheets

(56) References Cited

U.S. PATENT DOCUMENTS 5,025,858 A 6/1991 Glaser
5,048,606 A 9/1991 Allwin
5,113,940 A 5/1992 Glaser
5,147,857 A 9/1992 Raddatz et al.
5,224,540 A 7/1993 Streich et al.
5,246,069 A 9/1993 Glaser et al.
5,253,714 A 10/1993 Davis et al.
5,333,685 A 8/1994 Gilbert
5,376,200 A 12/1994 Hall
5,449,040 A 9/1995 Milner
5,484,040 A 1/1996 Penisson
5,819,846 A 10/1998 Bolt et al.
5,839,515 A 11/1998 Yuan et al.
5,842,517 A 12/1998 Coone
5,927,403 A 7/1999 Dallas
5,967,352 A 10/1999 Repp
5,984,007 A 11/1999 Yuan
6,167,963 B1 1/2001 McMahan et al.
6,241,018 B1 6/2001 Eriksen
6,353,771 B1 3/2002 Southland
6,354,372 B1 3/2002 Carisella et al.
6,425,442 B1 7/2002 Latiolais et al.
6,491,116 B2 12/2002 Berscheidt et al.
6,578,638 B2 6/2003 Guillory
6,708,768 B2 3/2004 Slup et al.
6,712,153 B2 3/2004 Turley et al.
6,899,181 B2 5/2005 Simpson et al.
7,044,230 B2 5/2006 Starr et al.
7,087,109 B2 8/2006 Bredt et al.
7,093,664 B2 8/2006 Todd et al.
7,255,178 B2 8/2007 Slup et al.
7,350,569 B2 4/2008 Collins et al.
7,350,582 B2 4/2008 McKeachnie et al.
7,475,736 B2 1/2009 Lehr et al.
7,484,940 B2 2/2009 O'Neill
7,735,549 B1 6/2010 Nish et al.
7,740,079 B2 6/2010 Clayton et al.
7,753,416 B2 7/2010 Mazzaferro et al.
7,762,323 B2 7/2010 Frazier
7,980,300 B2 7/2011 Roberts et al.
8,002,030 B2 8/2011 Turley et al.
8,016,295 B2 9/2011 Guest et al.
8,079,413 B2 12/2011 Frazier
8,113,276 B2 2/2012 Greenlee et al.
8,127,851 B2 3/2012 Misselbrook
8,167,033 B2 5/2012 White
8,205,671 B1 6/2012 Branton
8,211,248 B2 7/2012 Marya
8,231,947 B2 7/2012 Vaidya et al.
8,267,177 B1 9/2012 Vogel et al.
D673,182 S 12/2012 Frazier
8,336,616 B1 12/2012 McClinton
8,381,809 B2 2/2013 White
8,453,729 B2 6/2013 Harris et al.
8,459,346 B2 6/2013 Frazier
8,469,088 B2 6/2013 Shkurti et al.
8,567,492 B2 10/2013 White
8,596,347 B2 12/2013 Valencia et al.
8,839,855 B1 2/2014 McClinton et al.
8,770,276 B1 7/2014 Nish et al.
8,770,280 B2 7/2014 Buytaert et al.
8,887,818 B1 11/2014 Carr et al.
8,893,780 B2 11/2014 Greenlee et al.
9,080,405 B2 7/2015 Carisella
9,228,413 B2 1/2016 Fripp et al.
9,416,617 B2 8/2016 Wiese et al.
9,476,272 B2 10/2016 Carisella et al.
9,708,878 B2 7/2017 Cooke, Jr.
9,714,551 B2 7/2017 Okura et al.
9,745,847 B2 8/2017 Ditzler et al.
9,771,769 B2 9/2017 Baker et al.
9,790,763 B2 10/2017 Fripp et al.
9,810,035 B1 11/2017 Carr et al.
D806,136 S 12/2017 Saulou et al.
9,845,658 B1 12/2017 Nish et al.
9,982,506 B2 5/2018 Walton et al.
10,689,931 B2 6/2020 Mickey et al.
2003/0188876 A1 10/2003 Vick et al.
2003/0226660 A1 12/2003 Winslow et al.
2003/0236173 A1 12/2003 Dobson et al.
2004/0003928 A1 1/2004 Frazier
2004/0045723 A1 3/2004 Slup et al.
2004/0216868 A1 11/2004 Owen, Sr.
2005/0109502 A1 5/2005 Buc Slay et al.
2005/0183864 A1 8/2005 Trinder
2005/0194141 A1 9/2005 Sinclair et al.
2006/0243455 A1 11/2006 Telfer
2007/0003449 A1 1/2007 Hatamian et al.
2007/0039742 A1 2/2007 Costa
2007/0119600 A1 5/2007 Slup et al.
2008/0128133 A1 6/2008 Turley et al.
2008/0135231 A1* 6/2008 Moyes ..... E21B 23/06 166/123
2008/0196879 A1 8/2008 Broome et al.
2008/0264627 A1 10/2008 Roberts et al.
2008/0277162 A1 11/2008 DiFoggio
2009/0038790 A1 2/2009 Barlow
2009/0090516 A1 4/2009 Delucia et al.
2009/0229424 A1 9/2009 Montgomery
2009/0236091 A1 9/2009 Hammami et al.
2010/0155050 A1 6/2010 Frazier
2010/0263876 A1 10/2010 Frazier
2010/0276159 A1 11/2010 Mailand et al.
2010/0326660 A1 12/2010 Ballard et al.
2011/0024134 A1 2/2011 Buckner
2011/0048740 A1 3/2011 Ward et al.
2011/0048743 A1 3/2011 Stafford et al.
2011/0088891 A1 4/2011 Stout
2011/0094802 A1 4/2011 Vatne
2011/0186306 A1 8/2011 Marya et al.
2011/0232899 A1 9/2011 Porter
2011/0259610 A1 10/2011 Shkurti et al.
2011/0277989 A1 11/2011 Frazier
2011/0290473 A1 12/2011 Frazier
2012/0061105 A1 3/2012 Neer et al.
2012/0125642 A1 5/2012 Chenault et al.
2012/0181032 A1 7/2012 Naedler et al.
2012/0234538 A1 9/2012 Martin et al.
2012/0279700 A1 11/2012 Frazier
2013/0032357 A1 2/2013 Mazyar et al.
2013/0098600 A1 4/2013 Roberts
2013/0240201 A1 9/2013 Frazier
2013/0306331 A1 11/2013 Bishop et al.
2014/0020911 A1 1/2014 Martinez
2014/0027127 A1 1/2014 Frazier et al.
2014/0045731 A1 2/2014 Daccord
2014/0090831 A1 4/2014 Young et al.
2014/0116677 A1 5/2014 Sherlin
2014/0120346 A1 5/2014 Rochen
2014/0190685 A1 7/2014 Frazier et al.
2014/0224476 A1 8/2014 Frazier
2014/0251641 A1 9/2014 Marya et al.
2014/0345875 A1 11/2014 Murphree et al.
2014/0345878 A1 11/2014 Murphree et al.
2014/0374163 A1 12/2014 Rui et al.
2015/0013996 A1 1/2015 Davies et al.
2015/0027737 A1 1/2015 Rochen et al.
2015/0068728 A1 3/2015 Stage et al.
2015/0083394 A1 3/2015 Skarsen et al.
2015/0144348 A1 5/2015 Okura et al.
2015/0239795 A1 8/2015 Doud et al.
2015/0252638 A1 9/2015 Richards et al.
2015/0275070 A1 10/2015 Getzlaf et al.
2015/0354313 A1 12/2015 McClinton et al.
2015/0368994 A1 12/2015 Mhaskar et al.
2016/0115759 A1 4/2016 Richards et al.
2016/0122617 A1 5/2016 Murphree et al.
2016/0123104 A1 5/2016 Harris
2016/0130906 A1 5/2016 Garvey et al.
2016/0160591 A1 6/2016 Xu et al.
2016/0201427 A1 7/2016 Fripp et al.
2016/0265305 A1 9/2016 Davies et al.
2016/0281458 A1 9/2016 Greenlee
2016/0305215 A1 10/2016 Harris et al.

(56) References Cited

U.S. PATENT DOCUMENTS

| | | | |
|---|---|---|---|
| 2017/0044859 | A1 | 2/2017 | Blair |
| 2017/0101836 | A1 | 4/2017 | Webster et al. |
| 2017/0175488 | A1 | 6/2017 | Lisowski et al. |
| 2017/0183950 | A1 | 6/2017 | Gillis et al. |
| 2017/0260824 | A1 | 9/2017 | Kellner et al. |
| 2017/0260825 | A1 | 9/2017 | Schmidt et al. |
| 2017/0284167 | A1 | 10/2017 | Takahashi et al. |
| 2017/0321514 | A1 | 11/2017 | Crow |

FOREIGN PATENT DOCUMENTS

| | | |
|---|---|---|
| EP | 0890706 | 1/1993 |
| EP | 1643602 | 4/2006 |
| WO | 2007014339 | 2/2007 |
| WO | 2008100644 | 8/2008 |
| WO | 20091128853 | 9/2009 |
| WO | 2011097091 | 8/2011 |
| WO | 2011160183 | 12/2011 |
| WO | 2014197827 | 12/2014 |
| WO | 2016032761 | 3/2016 |
| WO | 2016182545 | 11/2016 |

* cited by examiner

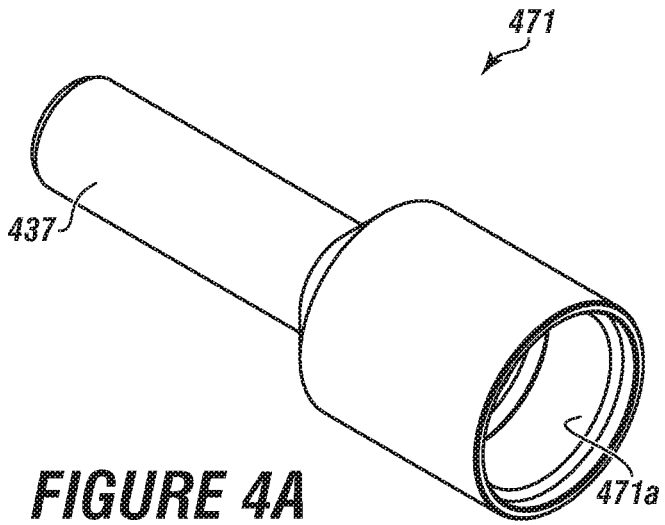
FIGURE 4A
FIGURE 4B
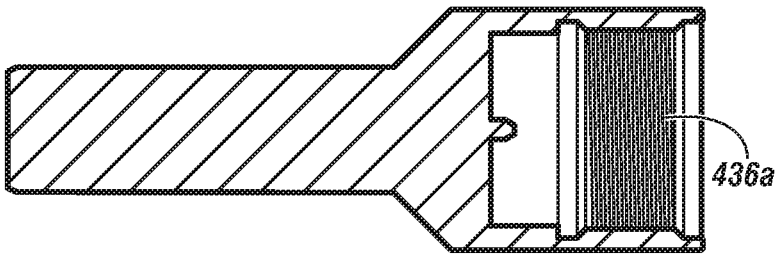

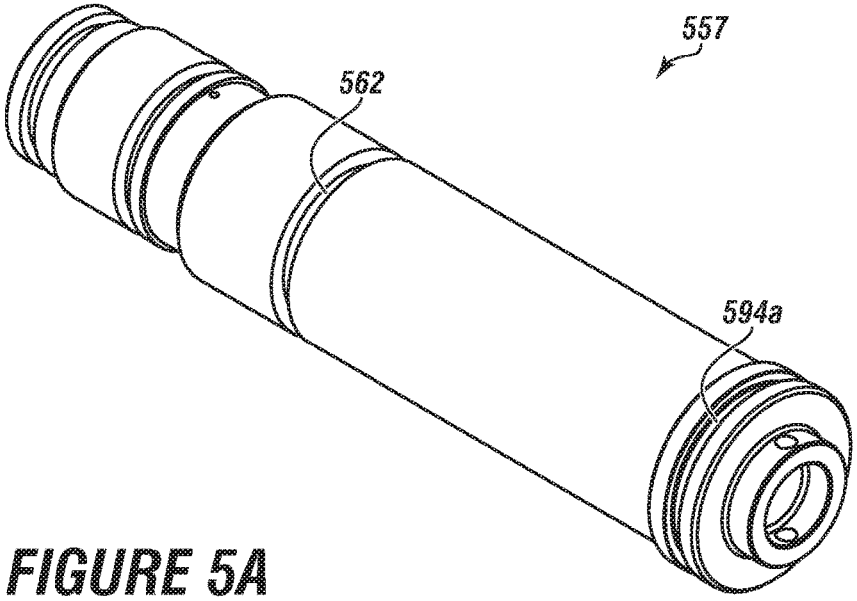
FIGURE 5A
FIGURE 5B
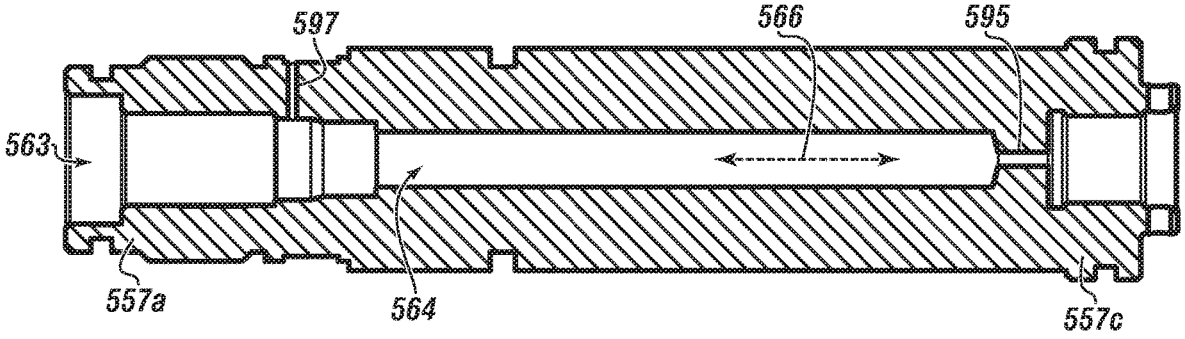

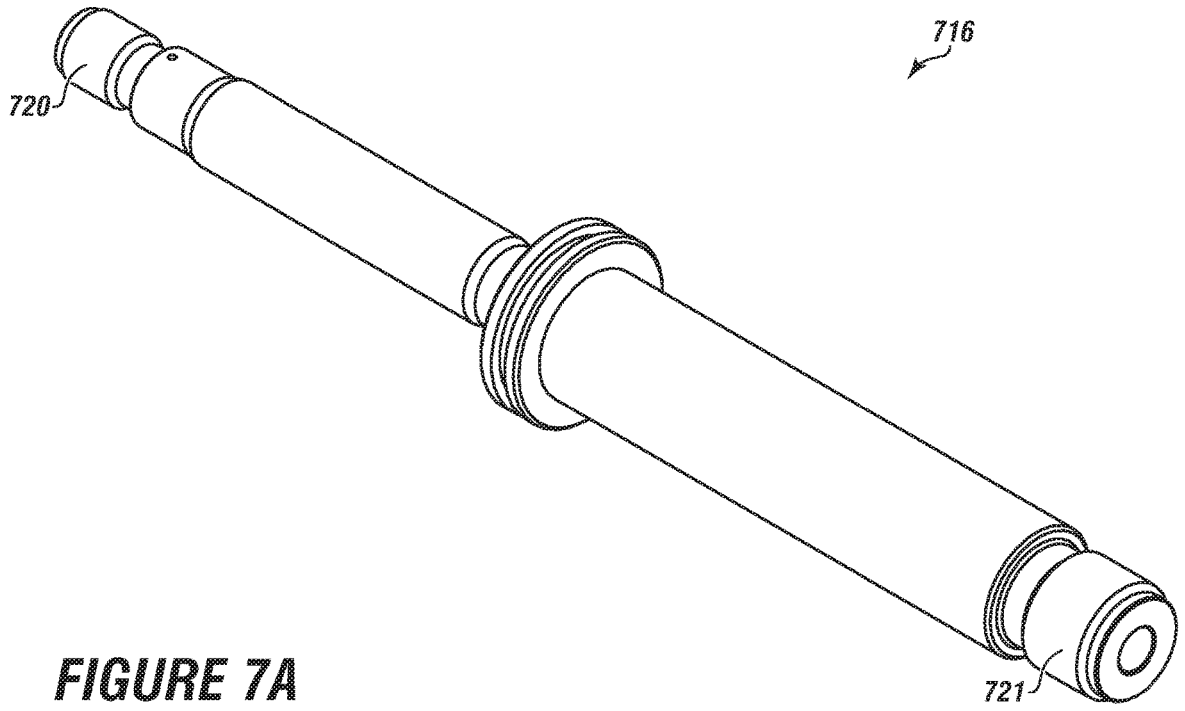
FIGURE 7A
FIGURE 7B
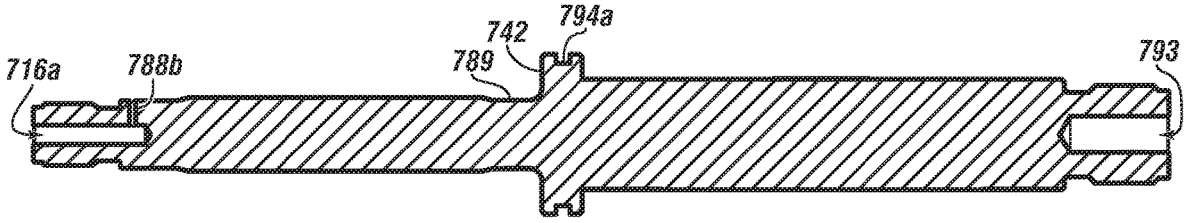

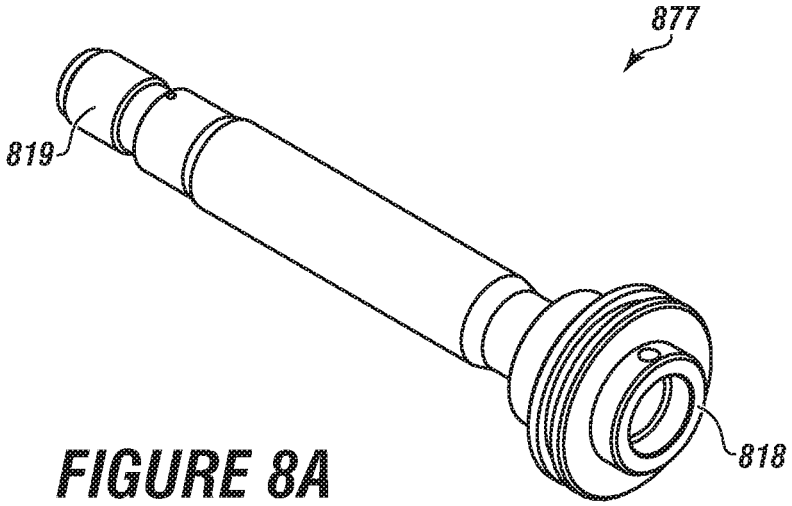
FIGURE 8A
FIGURE 8B
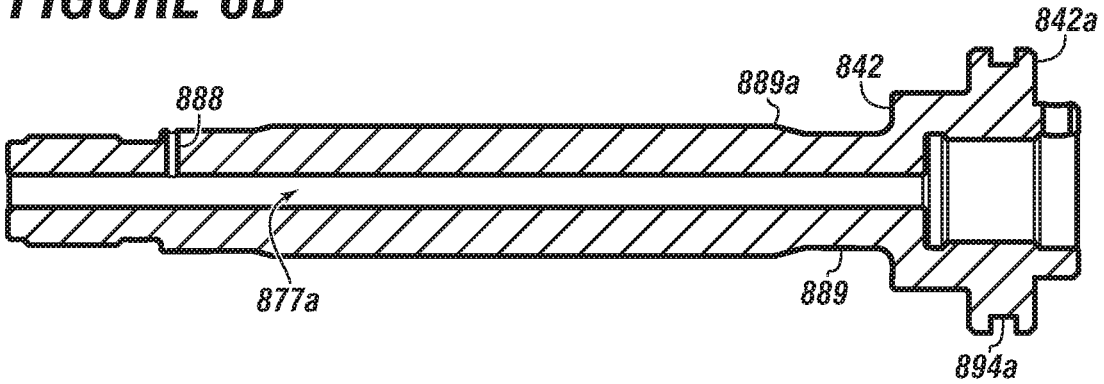

SETTING TOOL ASSEMBLY

CROSS-REFERENCE TO RELATED APPLICATIONS

This application claims priority to U.S. Provisional Patent Application Ser. Nos. 62/840,586, filed on Apr. 30, 2019, and 62/730,124, filed on Sep. 12, 2018. The disclosure of each application is hereby incorporated herein by reference in its entirety for all purposes.

INCORPORATION BY REFERENCE

The subject matter of U.S. non-provisional application Ser. No. 15/876,120, filed Jan. 20, 2018, Ser. Nos. 15/898,753 and 15/899,147, each filed Feb. 19, 2018, and Ser. No. 15/904,468, filed Feb. 26, 2018, is incorporated herein by reference in entirety for all purposes, including with particular respect to a composition of matter (or material of construction) for a (sub)component for a downhole or setting tool. One or more of these applications may be referred to herein as the "Applications".

STATEMENT REGARDING FEDERALLY SPONSORED RESEARCH OR DEVELOPMENT

Not applicable.

BACKGROUND

Field of the Disclosure

The present disclosure relates generally to a setting tool assembly apparatus and method for actuating various downhole tools. The setting tool assembly may utilize surrounding wellbore pressure.

Background of the Disclosure

An oil or gas well includes a wellbore extending into a subterranean formation at some depth below a surface (e.g., Earth's surface), and is usually lined with a tubular, such as casing, to add strength to the well.

During the construction, completion, recompletion, or work-over of a wellbore, there may be situations where one or more downhole tools may need to be actuated. FIG. 1 illustrates a conventional plugging system 100 that includes use of a downhole tool 102 used for plugging a section of a wellbore 106 drilled into formation 110. A tubular 108 (casing, casing string, etc.) is disposed in the wellbore 106. The tool or plug 102 may be lowered into the wellbore 106 (and within the tubular 108) by way of workstring 112 (e.g., e-line, wireline, coiled tubing, etc.) and/or with setting tool (assembly) 117, as applicable.

The tool may be a frac plug like that provided by Downhole Technology, LLC of Houston, Tex., and as provided for in multiple patents, including U.S. Pat. No. 8,997,853, incorporated herein in its entirety for all purposes, including as it pertains to a frac plug and setting thereof. Other tools and tool configurations may be used.

The setting tool 117 can be incorporated into the workstring 112 along with the downhole tool 102 in a manner known to one of skill. Examples of commercial setting tools include the Baker #10 and #20, and the 'Owens Go'. Technological advances in downhole tool technology, particularly as it pertains to fracing, have allowed the United States to reshape the global energy economy. However, while downhole tool technology has advanced, innovation around setting tools used in connection with the downhole tools has remained stagnant.

Thus, operators routinely use old, outdated setting tool technology, which has a detrimental impact (if not outright damage) on downhole tools of advanced complexity. This is particularly the case for modern wells that have significant horizontal deviation, as setting tools were originally designed and developed for use only in vertical orientation. Moreover, setting tools were not previously designed to account for impact on technologically advanced tools, particularly those that have electronics ultra-sensitive to shock. Thus, dampening after tool disconnect is important because there is just as much chance to damage other components within the workstring (such as those uphole of the setting tool) during run-out or other motion of the workstring via motion of setting tool components.

A conventional method for actuating (setting) a downhole tool is to generate a pressurized gas using a pyrotechnic (or power) charge of a setting tool that then converts into motion of a selected downhole tool or tool component. These tools typically have a housing (or sleeve), and the power charge therein. Ignition of the power charge may occur from various means, such as transmission of electrical current from the surface to an ignitor disposed proximate to the power charge. Once ignited, the power charge burns, which results in creating of a pressurized gas.

The downhole tool actuation time is dependent on the power charge burn time. With a particular composition and geometry, conventional burn times range from 1-3 seconds for a standard set power charge to 30-60 seconds for a slow-set power charge. When activated, the power charge begins to burn on a first end with the flame propagating towards a second end. The speed of the burn depends on various factors, including the length of the power charge and surrounding conditions.

Unfortunately, rapid burn of the power charge may result in too fast of pressurization, and thus too fast of actuation of the downhole tool, whereby the downhole tool is improperly activated or set. In the case of a frac plug, if the pressurization is too fast, the frac plug may not be able to properly set (anchor) and seal within the tubular. For some power charges, rapid burn may be intensified by the fact that as the temperature around the power charge increases, the burn rate increases. Thus, what may have initially been expected to be a 30-60 second burn rate and pressurization instead burns in 4-5 seconds resulting in what is tantamount to an explosion and a shock wave within the work string. This can also be significantly detrimental to the downhole tool, and may result in damage to the downhole tool or cause improper activation (e.g., insufficient setting or sealing, etc.).

There are appreciable peripheral costs associated with use of a power charge, as this material is an explosive that requires expertise in shipping, handling, as well as various permitting and licensing. To say nothing of the inherent danger to surrounding personnel during its handling and installation.

Another problem with setting tools is the overall length of the setting tool, along with maintenance requirements. In order to alleviate damage from impact forces that can occur just after disconnect, setting tools may incorporate a liquid (usually oil) dampener. But to do so requires increasing the length of the setting tool. Without the liquid dampener the components of the setting tool would be susceptible to incurring significant forces upon disconnect of the setting tool from a respective downhole tool. The use of a liquid dampener also comes with additional maintenance requirements.

Setting tools that do not use a power charge also exist. The operation of such a setting tool is typically tied to surrounding (hydrostatic) wellbore pressure. However, these setting tools require exact precision of downhole conditions in order to be properly configured. But because precision is nearly impossible in such conditions, these setting tools routinely fail to properly set the associated tool.

What is need is a setting tool that facilitates a shorter setting tool, which may be accomplished by a built-in pressure equalizer that eliminates the need for oil or liquid dampener chambers. What is needed is a setting tool that is reliable and reusable, and thus provides synergized drivers for operators to move away from archaic setting tool technology. There is a great need in the art for a setting tool that effectively utilizes surrounding wellbore pressure to set a downhole tool, thereby eliminating the need of a power charge, and may do so without exact knowledge if downhole conditions.

SUMMARY

Embodiments of the disclosure pertain to a method of using a setting tool assembly to set a downhole tool in a wellbore that may include one or more steps of: running a workstring into the wellbore to a desired location; and activating an initiating event.

The method may include the workstring having a lower end having a setting tool assembly coupled with the downhole tool. The setting tool assembly may include a head adapter coupled with the workstring. There may be an upper housing coupled with the head adapter. The upper housing may have an inner bore. The inner bore may include an inner housing piston bore and/or an inner housing insert bore.

There may be a piston disposed within the inner housing piston bore. There may be an insert disposed within the inner housing insert bore. Instead of the insert, there may be an integral tortuous flowpath within the upper housing.

There may be a trigger device disposed within the head adapter. The trigger device may be operably configured to receive an activation signal. For example, the activation signal may be transmitted from surface equipment down through the workstring (or possibly external) to the trigger device. The trigger device may be operably coupled (directly or indirectly) with whatever equipment and peripheral components necessary to receive such a signal (such as wiring, telemetry, and the like).

The trigger device may be configured to hold the piston in a first position. In a first position, internals of the setting tool assembly are not in fluid communication with external fluid pressure. The trigger device may be configured to facilitate movement of the piston to a second position after receiving the activation signal. Thus, the trigger device may undergo some form of altering or change whereby the piston may be released or no longer prevented from moving.

The assembly may include a first stage housing releasably coupled with the upper housing. To that end, any number of 'housings' may be used. There may be a first stage mandrel disposed within the first stage housing. The first stage mandrel may be coupled with the upper housing. Upon assembly, there may be a first pressure chamber formed between the first stage housing and the first stage mandrel. Other chambers may be formed between other respective mandrels and housing. Upon assembly, there may be one or more equalization chambers formed. A pressure chamber may not be in fluid communication with a respective equalization chamber when the piston is in the first position. After the downhole tool is set, the pressure chamber may be in fluid communication with the respective equalization chamber. The setting tool assembly may thus be in equilibrium with the wellbore pressure.

The assembly may include a setting sleeve adapter having a first end coupled with the first stage mandrel. The number of stages may determine which end housing the setting sleeve adapter couples to. The setting sleeve adapter may have a second sleeve end coupled with a setting sleeve. The coupling may be threaded, bolted, and so forth.

In aspects, the the setting sleeve adapter may be movingly disposed around the first stage mandrel. The setting sleeve adapter may be movingly disposed around other mandrels, as may be applicable.

The method may include causing the activation signal to transmit in a manner to activate the trigger device. This can be, for example, from a mobile device. As another example, an operator may be at a workstation and activate an app or program, or toggle a switch. Whatever signal transfer mechanism used may result in the piston being subsequently moved to a second position. This may be the result of fluid pressure from a wellbore fluid acting thereon. Once moved, (fluid) pressure may enter the first pressure chamber.

The piston may include a first working surface having a first surface area, and a second working surface having a second surface area. These surfaces may have a surface ratio of the first surface area to the second surface area in a surface area range of 1.1:1 to 1.4:1.

The setting tool may have a total stroke distance of 7 inches to 10 inches. The setting tool may have an effective stroke distance of 4 inches to 6.5 inches. Setting of the downhole tool may occur with a stroke distance of about 3 inches to about 7 inches.

In aspects, the first stage housing may be releasably coupled to the inner housing with one or more shearing devices. The shearing devices may have a cumulative shea and wherein the one or more shearing devices shear in a range of 5000 lbf to 9000 lbf. This means there may need to be a pressure of at least 1000 psi within one or more pressure chambers. Once released, the downhole tool begins to set.

Any pressure chamber like that of the first pressure chamber need not be in fluid communication with the wellbore when the piston is in the first position. However, any pressure chamber like that (and including) the first pressure chamber may be in fluid communication with the wellbore when the piston is in the second position (or moved at least partially from the first position).

The tool assembly may include the use of a tortuous flow path. In aspects, the insert may include a plurality of channels configured to create a tortuous path for the wellbore fluid flowing thereby.

The first stage housing may include a first inner shoulder movingly and sealingly engaged with the first mandrel. After downhole tool is set, the first inner shoulder may be moved radially proximate an equalization groove formed in the first mandrel. The groove may be reached after the setting tool moves a stroke distance of at least four inches. In aspects, the downhole tool may be set before the shoulder reaches a groove corner. Other housings/mandrels may have similar configurations.

The first stage housing may include a first stage working surface having a first stage working surface area in a range of four square inches to six square inches. The working surface may be within the first pressure chamber. The working surface may include or be associated with the first inner shoulder.

Embodiments herein pertain to a setting tool assembly for setting a downhole tool that may include one or more of the following: an adapter housing configured for coupling the setting tool assembly with a workstring; an upper housing coupled with the adapter housing, and further having an inner housing piston bore; a piston disposed within the inner housing piston bore; and a trigger device disposed within the adapter housing.

The trigger device may be operably configured to receive an activation signal. The trigger device may be configured to hold the piston in a first position. The trigger device may be configured to facilitate (or no longer prevent) movement of the piston to a second position after receiving the activation signal.

The setting tool assembly may include a first stage housing releasably coupled with the upper housing. Other housings may be used. There may be a first stage mandrel disposed within or proximate to the first stage housing. The first stage housing may be coupled with the upper housing. There may be a first pressure chamber is formed between the first stage housing and the first stage mandrel upon assembly. There may be an equalization pressure chamber formed.

The setting tool assembly may include a setting sleeve adapter having a first end coupled with the first stage mandrel. The setting sleeve adapter may be coupled as desired. In embodiments, there need not be a setting sleeve adapter. When used, the setting sleeve adapter may be movingly disposed around (and radially proximate) an applicable mandrel, such as the first stage mandrel.

The setting tool assembly may include an insert bore disposed or otherwise formed in the upper housing. There may be an insert is disposed within the insert bore. The insert may be configured to provide a tortuous flowpath through the upper housing (and thus the assembly).

The piston may include a first working surface having a first surface area, and a second working surface having a second surface area. A surface ratio of the first surface area to the second surface area is in a surface area range of 1.01:1 to 1.4:1.

The first surface area may be about 1 square inch to about 1.5 square inches. The second surface area may be about 0.5 square inches to about 1 square inch.

The setting tool assembly may be configured for the housing to releasably disconnect from the upon about 6000 to about 9000 lbf. The setting tool assembly may be configured to disconnect from the downhole tool upon about 20,000 lbf to about 50,000 lbf (tension force).

For releasable disconnect of the housing from the mandrel and/or disconnect from the setting tool, there may be about 1000 psi to about 10,000 psi within a respective pressure chamber. Disconnect from the setting tool may not occur until a sufficient amount of tool stroke has happened.

The insert may be an elongated member configured with a plurality of baffles thereon. One or more of the plurality of baffles may include an at least one respective channel formed therein. The baffles may be circular in nature, and generally symmetrical to each other in shape. But asymmetrical configurations may be possible. The baffles may be about equidistantly spaced. However, the baffles also may be spaced with varied distance. The channel may be formed longitudinally through an outer edge of the baffles. The channels may be formed in an alternating fashion. For example, a first channel on a first baffle on a top side edge, and an adjacent channel for an adjacent baffle about 1 degree to 180 degrees offset. In embodiments, the offset may be an alternating 180 degrees between each adjacent baffle. The elongated member may have helically wound vanes disposed therearound.

A total stroke (or total stroke length) of the setting tool assembly may be equivalent to the sufficient effective stroke added to a dampening stroke. The total stroke length may be a distance of about 5 inches to 10 inches. The effective stroke may have a length in the range of about 4 inches to about 6.5 inches.

The setting tool assembly reaching the total stroke may include the first pressure chamber being in fluid communication with the dampening or equalization chamber, and pressure may be equalized therebetween.

The setting tool assembly may be void of liquid oil dampener.

The setting tool assembly may be void of a power charge.

These and other embodiments, features and advantages will be apparent in the following detailed description and drawings.

BRIEF DESCRIPTION OF THE DRAWINGS

For a more detailed description of the present disclosure, reference will now be made to the accompanying drawings, wherein:

FIG. 4A shows an isometric view of a of a head adapter according to embodiments of the disclosure;

FIG. 4B shows a longitudinal side cross-sectional view of the head adapter of FIG. 4A according to embodiments of the disclosure;

FIG. 5A shows an isometric view of an upper housing according to embodiments of the disclosure;

FIG. 5B shows a longitudinal side cross-sectional view of the upper housing of FIG. 5A according to embodiments of the disclosure;

FIG. 7A shows an isometric view of a tension mandrel according to embodiments of the disclosure;

FIG. 7B shows a longitudinal side cross-sectional view of the tension mandrel of FIG. 7A according to embodiments of the disclosure;

FIG. 8A shows an isometric view of a stage mandrel according to embodiments of the disclosure; and FIG. 8B shows a longitudinal side cross-sectional view of the stage housing of FIG. 8A according to embodiments of the disclosure.

DETAILED DESCRIPTION

Figure 1:
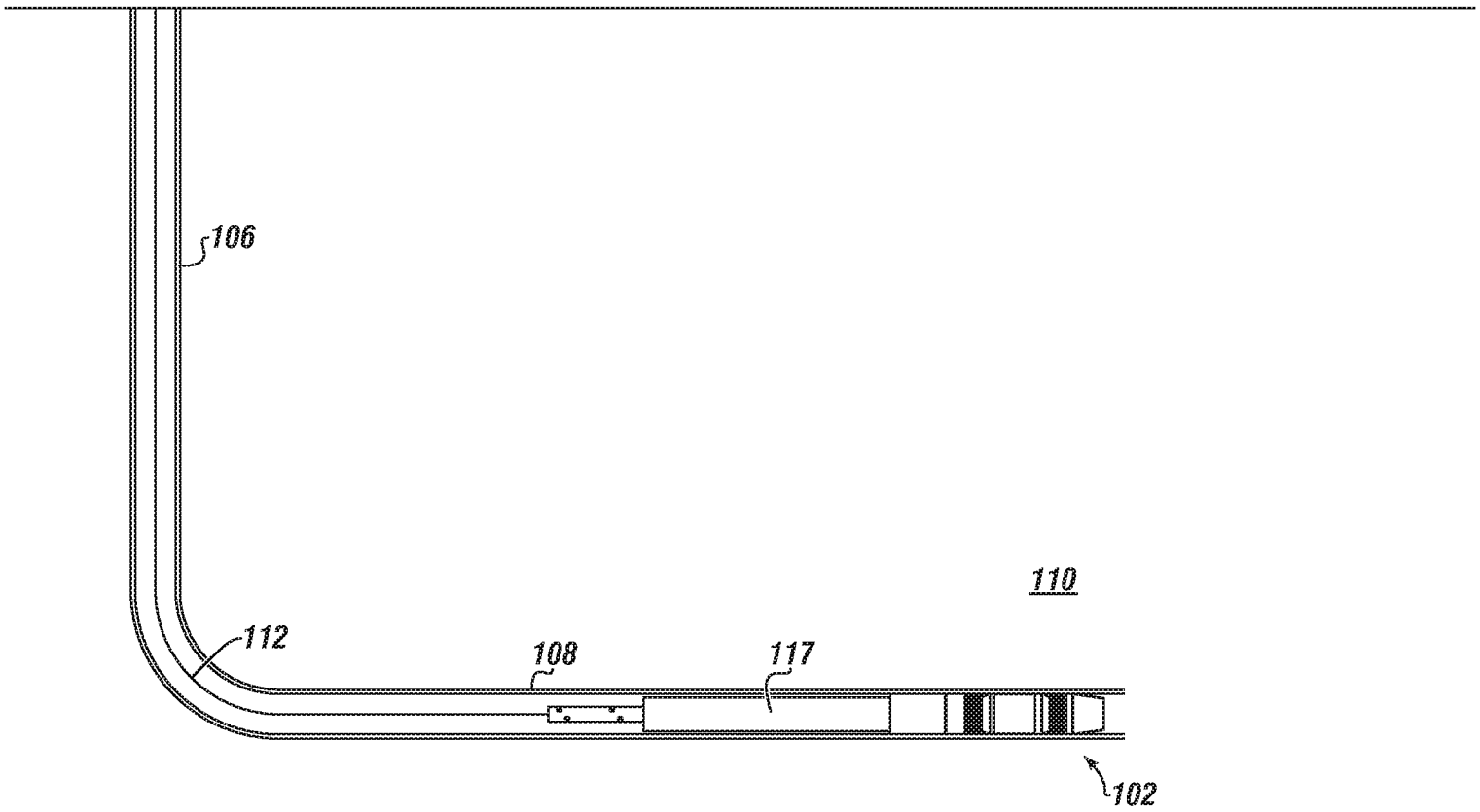
FIGURE 1 (PRIOR ART)
FIG. 1 is a side view of a process diagram of a conventional plugging system.

Herein disclosed are novel apparatuses, systems, and methods that pertain to downhole tools usable for wellbore operations, and aspects (including components) related thereto, the details of which are described herein.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., may be used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure.

Embodiments herein may be described at the macro level, especially from an ornamental or visual appearance. Thus, a dimension, such as length, may be described as having a certain numerical unit, albeit with or without attribution of a particular significant figure. One of skill in the art would appreciate that the dimension of "2 centimeters" may not be exactly 2 centimeters, and that at the micro-level may deviate. Similarly, reference to a "uniform" dimension, such as thickness, need not refer to completely, exactly uniform. Thus, a uniform or equal thickness of "1 millimeter" may have discernable variation at the micro-level within a certain tolerance (e.g., 0.001 millimeter) related to imprecision in measuring and fabrication.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, multi-phase, etc. and is not limited to any particular type of fluid such as hydrocarbons.

The term "composition" or "composition of matter" as used herein may refer to one or more ingredients, components, constituents, etc. that make up a material (or material of construction). For example, a material may have a composition of matter. Similarly, a device may be made of a material having a composition of matter. The composition of matter may be derived from an initial composition. Composition may refer to a flow stream of one or more chemical components.

The term "chemical" as used herein may analogously mean or be interchangeable to material, chemical material, ingredient, component, chemical component, element, substance, compound, chemical compound, molecule(s), constituent, and so forth and vice versa. Any 'chemical' discussed in the present disclosure need not refer to a 100% pure chemical. For example, although 'water' may be thought of as H2O, one of skill would appreciate various ions, salts, minerals, impurities, and other substances (including at the ppb level) may be present in 'water'. A chemical may include all isomeric forms and vice versa (for example, "hexane", includes all isomers of hexane individually or collectively).

For some embodiments, a material of construction may include a composition of matter designed or otherwise having the inherent characteristic to react or change integrity or other physical attribute when exposed to certain wellbore conditions, such as a change in time, temperature, water, heat, pressure, solution, combinations thereof, etc. Heat may be present due to the temperature increase attributed to the natural temperature gradient of the earth, and water may already be present in existing wellbore fluids. The change in integrity may occur in a predetermined time period, which may vary from several minutes to several weeks. In aspects, the time period may be about 12 to about 36 hours.

The term "fracing" or "frac operation" as used herein may refer to fractionation of a downhole well that has already been drilled. The same may also be referred to and interchangeable with the terms facing operation, fractionation, hydrofracturing, hydrofracking, fracking, hydraulic fracturing, frac, and so on. A frac operation may be land or water based.

The term "stroke" or "total stroke" as used herein may refer to a complete range of total movement of a sliding sleeve with respect to a starting position, typically in a magnitude of inches. The starting position may be analogous to a pre-stroke position, and the final position may be analogous to a post-stroke position or total stroke.

The term "effective stroke" as used herein may refer to the range of movement of a sliding sleeve or housing with respect to a starting position, to which a downhole tool may be set. Typically, the effective stroke may be in a magnitude of inches. The setting stroke may be an intermediate position within the range of or equal to the effective stroke. The amount of stroke required for setting and disconnect of the downhole too may be less than or equal to the effective stroke. The effective stroke may be the length of stroke immediately proceeding pressure equalization.

The term "dampening stroke" (also equalization stroke) as used herein may refer to the range of movement of a sliding sleeve or housing after the setting stroke, and after the effective stroke. The total stroke of the setting tool may equal the effective stroke plus the dampening stroke.

Figure 2A:
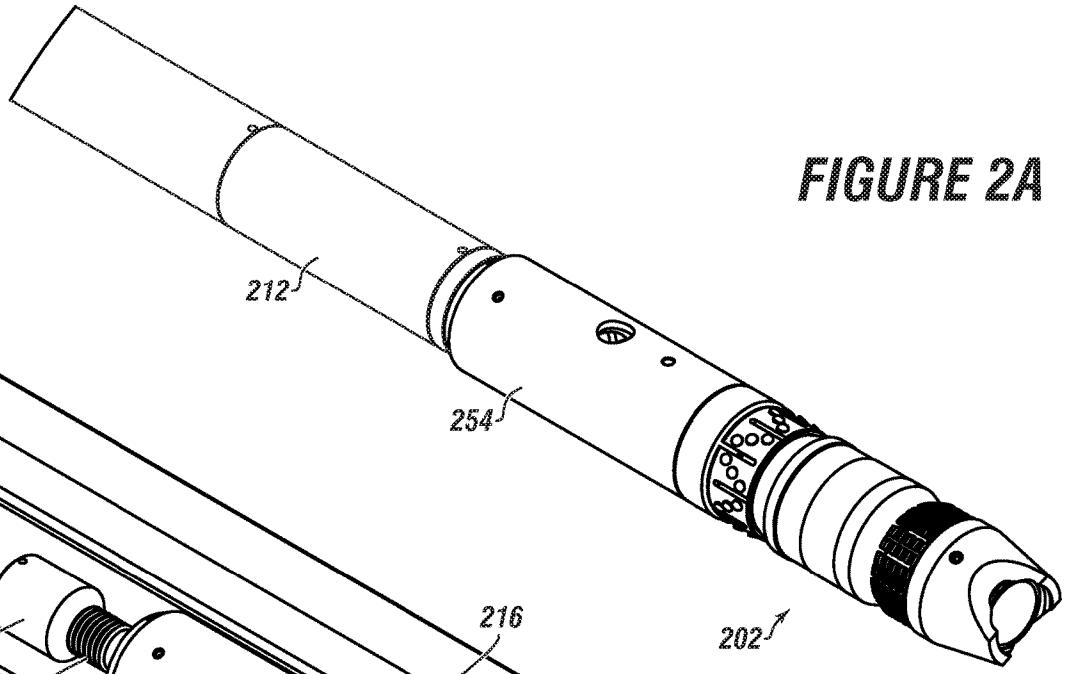
FIG. 2A shows an isometric view of a system having a downhole tool, according to embodiments of the disclosure.
Figure 2B:
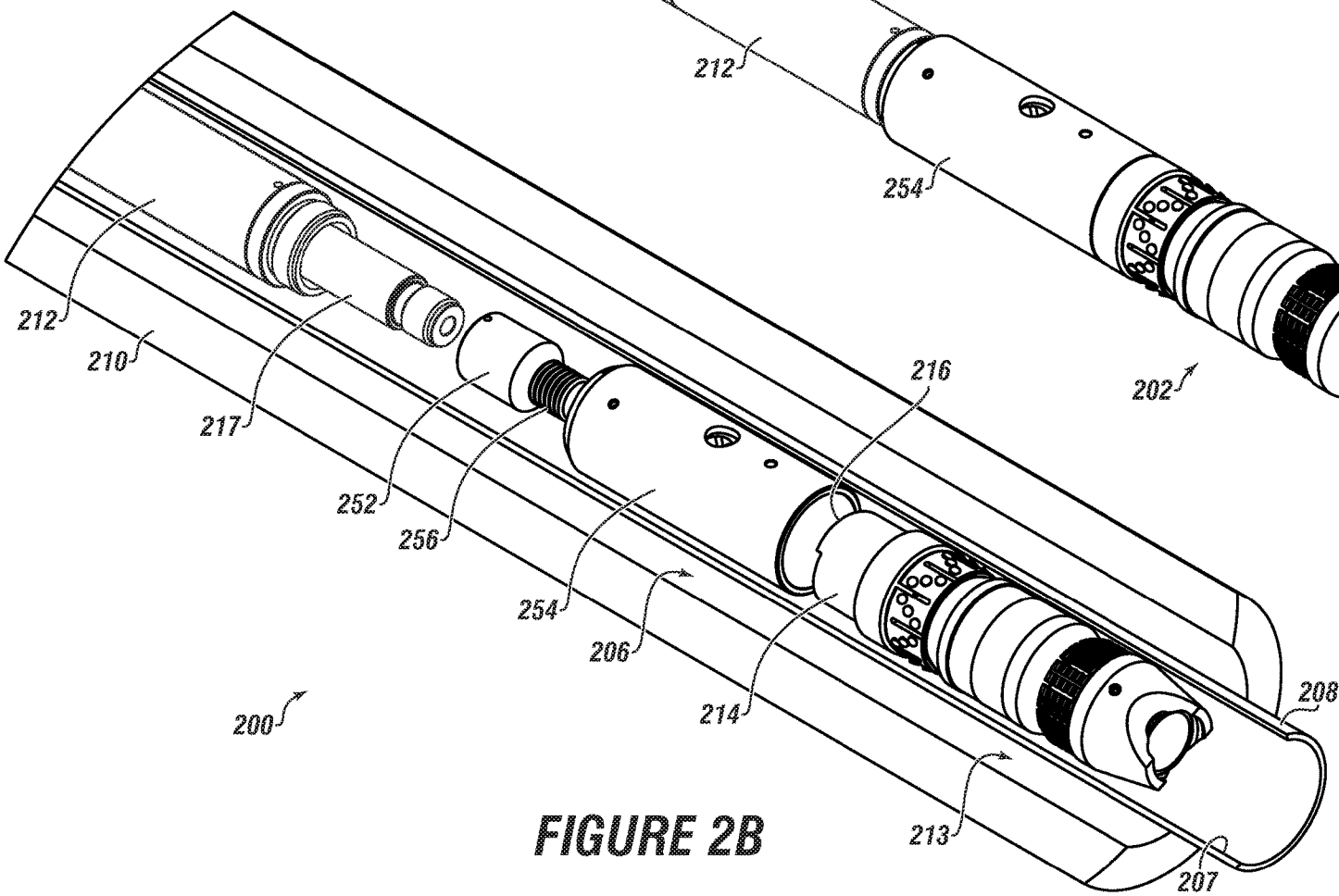
FIG. 2B shows an isometric view of a system having a downhole tool, according to embodiments of the disclosure.

Referring now to FIGS. 2A and 2B together, isometric views of a system 200 having a downhole tool 202 illustrative of embodiments disclosed herein, are shown. FIG. 2B depicts a wellbore 206 formed in a subterranean formation 210 with a tubular 208 disposed therein. In an embodiment, the tubular 208 may be casing (e.g., casing, hung casing, casing string, etc.) (which may be cemented). A workstring 212 (which may include a part 217 of a setting tool coupled with adapter 252—which may have threads 256) may be used to position or run the downhole tool 202 into and through the wellbore 206 to a desired location.

In accordance with embodiments of the disclosure, the tool 202 may be configured as a plugging tool, which may be set within the tubular 208 in such a manner that the tool 202 forms a fluid-tight seal against the inner surface 207 of the tubular 208. In an embodiment, the downhole tool 202 may be configured as a bridge plug, whereby flow from one section 213 of the wellbore to another (e.g., above and below the tool 202) is controlled. In other embodiments, the downhole tool 202 may be configured as a frac plug, where flow into one section 213 of the wellbore 206 may be blocked and otherwise diverted into the surrounding formation or reservoir 210.

In yet other embodiments, the downhole tool 202 may also be configured as a ball drop tool. In this aspect, a ball may be dropped into the wellbore 206 and flowed into the tool 202 and come to rest in a corresponding ball seat at the end of the mandrel 214. The seating of the ball may provide a seal within the tool 202 resulting in a plugged condition, whereby a pressure differential across the tool 202 may result. The ball seat may include a radius or curvature.

In other embodiments, the downhole tool 202 may be a ball check plug, whereby the tool 202 is configured with a ball already in place when the tool 202 runs into the wellbore. The tool 202 may then act as a check valve, and provide one-way flow capability. Fluid may be directed from the wellbore 206 to the formation with any of these configurations.

Once the tool 202 reaches the set position within the tubular, the setting mechanism or workstring 212 may be detached from the tool 202 by various methods, resulting in the tool 202 left in the surrounding tubular and one or more sections of the wellbore isolated. In accordance with the disclosure, the setting tool 217 may be activated via a signal. The signal may be via electric transmission from a surface facility (operator workstation, etc.) through the workstring 212 down tool the setting tool 217.

Upon activation, a trigger mechanism (not shown here) may activate in such a manner that a surrounding wellbore fluid (pressure) may be transferred or otherwise allowed to flow into the setting tool 217 (whereas prior to activation, the fluid may be blocked or prevented from entry into the setting tool 217). The pressure of the fluid may act on one or more working surfaces within the setting tool 217 that consequently begins to move (or urge) one or more housings or sleeves against the downhole tool 202.

Although not limited, the wellbore fluid may have a fluid pressure range of about 1000 psi to about 10,000 psi. In some embodiments, the fluid pressure may be in a range of about 100 psi to about 1000 psi. In low-pressure environments, the wellbore pressure may be stimulated or increased, such as via the use of injection pressure via surface equipment (pumps).

In an embodiment, once the tool 202 is set, tension may be applied to the adapter 252 until the threaded connection between the adapter 252 and the mandrel 214 (or other component of the tool 202) is broken. For example, the mating threads on the adapter 252 and/or the mandrel 214 (e.g., 256) may be designed to shear, and thus may be pulled and sheared accordingly in a manner known in the art. The amount of load applied to the adapter 252 may be in the range of about, for example, 20,000 to 55,000 pounds force. The amount of load is not meant to be limited, as the setting tool assembly 217 of the disclosure may be used with varied downhole tools and environments. It would be apparent that the setting force requirement is less than the disconnect force requirement.

Accordingly, the adapter 252 may separate or detach from the mandrel 214 (or other component of the tool 202), resulting in the workstring 212 being able to separate from the tool 202, which may be at a predetermined moment. The loads provided herein are non-limiting and are merely exemplary. The setting force may be determined by specifically designing the interacting surfaces of the tool, surface area, the respective tool surface angles, etc. The tool 202 may also be configured with a predetermined failure point (not shown) configured to fail or break. For example, the failure point may break at a predetermined axial force greater than the force required to set the tool but less than the force required to part the body of the tool.

Referring now to FIGS. 3A, 3B, 3C, 3D, 3E, and 3F together, a longitudinal side cross-sectional view of a setting tool assembly prior to setting of a downhole tool, a longitudinal side cross-sectional view of the setting tool connected with the downhole tool and in an activated position, a longitudinal side cross-sectional view of the setting tool assembly after disconnect from the downhole tool, an isometric component break-out view of a setting tool assembly useable with the downhole tool, a zoom-in cross-sectional view of a piston in a first position, and a zoom-in cross-sectional view of an equalization flow path, respectively, according to embodiments disclosed herein, are shown.

Although referenced as a setting tool, the setting tool 317 may be understood to be an assembly, and thus an assembly of various (sub)components, namely, one or more outer housings, inner housings, mandrels, pistons, sealing member (e.g., o-rings), and so forth. 'Setting tool' and 'setting tool assembly' are meant to have the same meaning. One or more members may be slidingly movable with respect to others. As evident here, the setting tool 317 may be void of an oil chamber and/or a power charge.

Figure 3A:
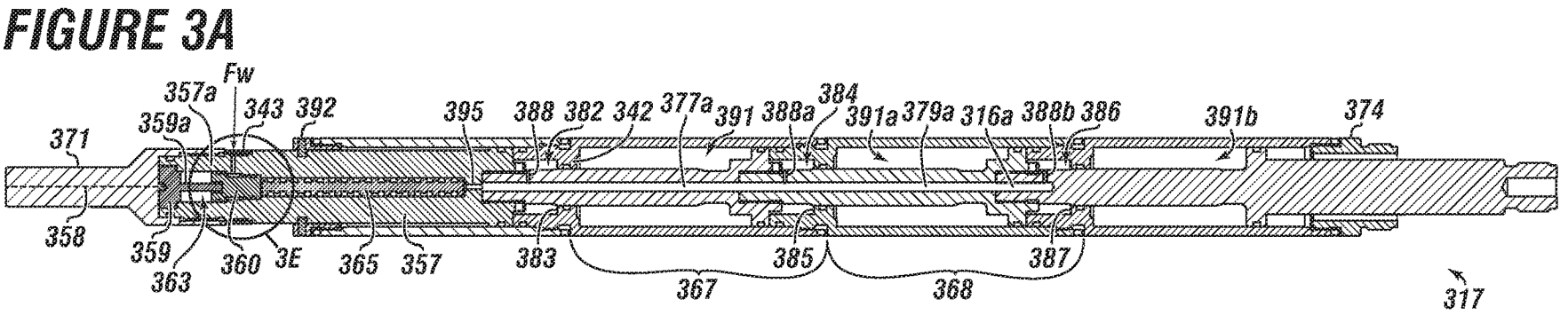
FIG. 3A shows a longitudinal side cross-sectional view of a setting tool assembly prior to initiating an activation event according to embodiments of the disclosure.
Figure 3B:
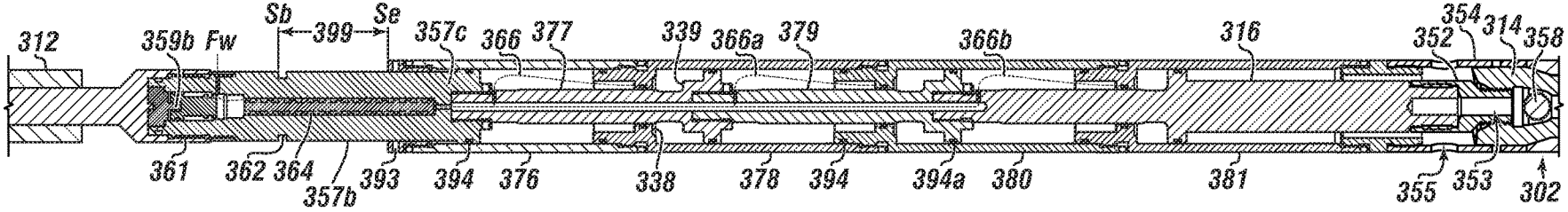
FIG. 3B shows a longitudinal side cross-sectional view of the setting tool of FIG. 3B connected with a downhole tool according to embodiments of the disclosure.
Figure 3C:
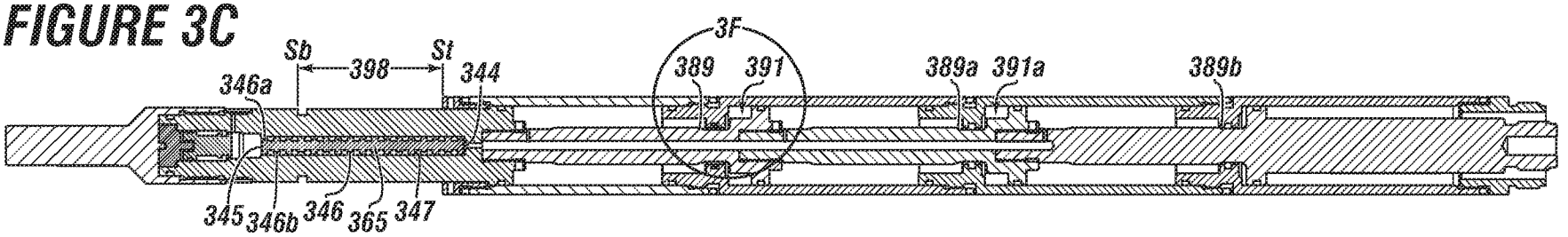
FIG. 3C shows a longitudinal side cross-sectional view of the setting tool assembly of FIG. 3B after the activation event and disconnect from the downhole tool according to embodiments of the disclosure.
Figure 3D:
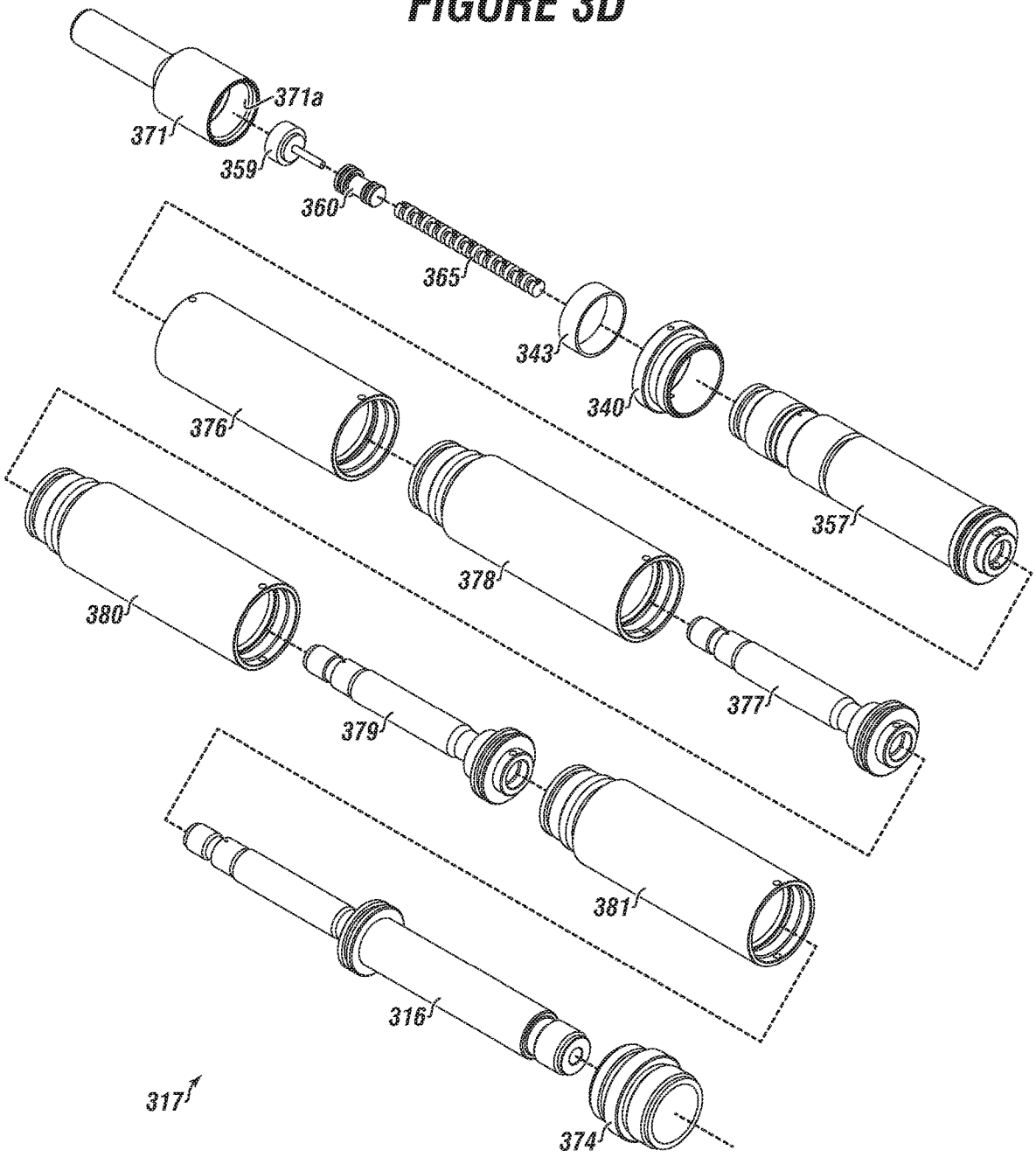
FIG. 3D shows an isometric component breakout view of a setting tool assembly according to embodiments of the disclosure.

FIG. 3D shows a simple tool assembly view of a head adapter 371 coupled with a first or upper housing 357. The head adapter 371 may be readily adaptable to connect with varied connection points of a workstring 312. Thus, the head adapter housing 371 may be contemplated as just being an 'adapter housing'. Within the housing(s) 371, 357 may be a trigger device or mechanism 359, an inner piston 360, and an insert 365. The setting tool 317 may include the upper housing 357 coupled with a first (pressure) stage housing 376, said housing 376 may then be coupled with a subsequent second stage housing 378.

The setting tool 317 may have one or more 'stages' (367, 368, etc.) as described herein, and is not meant to be limited. The use or configuration of stages may be dependent upon surrounding wellbore pressure or user option. Thus, there may just be one mandrel (e.g., 377) coupled between the housing 357 and a downhole tool 302.

As shown here, the second stage housing 378 may be coupled with a third or last stage housing 380, which may subsequently be coupled with a tension mandrel housing 381. A respective housing may have a respective piston or mandrel proximately disposed therein. For example, there may be a first stage mandrel 377 disposed within the first stage housing 376, and a second stage mandrel 379 disposed within the second stage housing 378. In lieu of a third stage mandrel, there may be a tension mandrel 316 configured to be proximately disposed within a third stage housing 380 and/or a tension mandrel housing 381. In embodiments there may only be one stage, for which the 'stage' mandrel may be like the tension mandrel 316.

For flexibility and convenience, the setting tool assembly 317 may include a setting sleeve adapter 374, whereby the assembly 317 may be readily coupled with any number of setting sleeves and/or tool adapters.

The setting sleeve adapter 374 may be associated with operable systems, subsystems, assemblies, modules, skids, and so forth, including those described herein. The setting sleeve adapter 374 may be of any suitable shape, such as generally cylindrical or comparable. The setting sleeve adapter 374 may be made of any material known for durability in wellbore operations, such as cast iron or steel. The setting sleeve adapter 374 may be just that—a member configured to be adaptable to any type of setting sleeve. Thus, the setting sleeve adapter 374 may provide universal coupling ability between the setting tool assembly 317 and whatever downhole tool may be selected for setting.

The setting sleeve adapter 374 may have be an upper adapter end configured for coupling with a lower end of a housing, such as tension mandrel housing 381. The coupling may be securable, such as via threaded and/or use of set screws. Thus, the upper end 774*a* may have an inner thread profile. The upper end may have an adapter side bore to which a set screw or the like may be inserted.

The setting sleeve adapter 374 may have an inner surface thereof that may be configured for sliding engagement with an outer surface of a tension mandrel (not shown here). The adapter 374 may be configured for threadingly attaching to another threaded member via threads, such as with the setting sleeve 354 (which ultimately engages with a downhole tool). Threads include stub acme, buttress, and the like. In addition to threads, one or more set screws or other retainer mechanism may be screwed into recess region(s). To aid sealing engagement, there may be one or more orings disposed between proximate surfaces, such as within oring recess(es), as would be apparent to one of skill in the art.

For brevity and simplicity, components uphole or downhole of the assembly 317 may be shown in part, or not at all. However, one of skill would appreciate their presence in an operational sense, even if not depicted in the Figures in totality or at all.

Referring to the Figures together, the upper (or sometimes 'inner;) housing 357 may be an elongated cylindrical-type member, albeit with varied OD and/or ID in portions thereof. There may be an upper end 357*a* of the inner housing adaptable for attachment with the head housing 371. The head housing 371 may be configured for coupling the assembly 317 with part of a workstring (or a component thereof) 312.

The upper housing 357 may be configured for attaching to the head housing 371, such as via threaded connection 361. Thus, each of the inner housing 357 and the head housing 371 may have respective threads configured for mating. Threads may include stub acme, buttress, and the like. One of skill would appreciate that other (sub)components of the setting tool 317 may be coupled in a similar manner, even if not shown or described in detail here.

The assembled tool 317 may have one or more dampening or equalization chambers 391*a*, 391*b* in accordance with embodiments herein. In the assembled and run-in configuration, these chambers typically would be anticipated to have about an equal ambient air pressure therein, as the assembly is likely to occur in a shop, worksite, etc. where pressure is ambient. It is within the scope of the disclosure that any such chamber(s) may be configured with another dampening mechanism (not shown here), such as a spring, a resilient rubber, a bellow, and so forth. The dampening mechanism may be configured for mitigating or reducing impact force between components of the setting tool 317 as the tool moves to its total stroke St position.

The inner housing 357 may have a housing bore, which may be further contemplated as having a first section or piston bore (or chamber, etc.) 363 and a second section or insert bore (or chamber, etc.) 364. The piston bore 363 may have the inner (movable) piston 360 disposed therein, and in a comparable manner the insert bore 364 may have the insert 365 disposed therein.

The insert 365 may be an elongated member of any suitable shape to reside within the bore 364 (such insert diameter 349 may be substantially equivalent to the inner bore diameter). As shown here, the insert may be a generally cylindrical rod 345 configured with a plurality of baffles 347. The baffles 347 are not limited, and any also be any suitable shape. Here, the baffles 347 are shown as cylindrical members extending radially from the rod 345. Other fin-type shapes are possible, such as helically wound vane(s). The rod 365 may have internal channels formed therein (not shown here). In embodiments, there may not be a bore 364, and instead an integral tortuous flowpath may be used.

The outer edges/surfaces 348 of any respective baffle may have a channel 346 formed therein. The channels 346 may be longitudinal in nature whereby fluid may pass thereby in order to move to the next channel, and so forth. The channels may have an alternating or offset configuration (see 346*a* and 346*b*). The alternating or offset between adjacent channels may be in an offset range of about 1 degree to about 180 degrees.

A first end of the insert 345 may be engaged or proximate to the piston 360, while a second end 344 may be proximate a lower port 395.

The head housing 371 may analogously have a corresponding head bore 371*a* for the trigger device (e.g., switch) 359 to fit therein. One of skill would appreciate that upon coupling, the trigger device 359, piston 360, etc. may be contemplated as being relatively disposed within each of the housings 371 and 357.

Actuation of the trigger device 359 may be from or via a signal from the surface (e.g., surface facility, an operator, etc.). The signal may be transmitted via telemetry, wire connection, mud pulse, or other suitable forms of communicating signals downhole. The signal may be electrically transmitted via wiring 358 connected through the workstring 317 and operatively coupled with the trigger device 359.

The trigger device 359 may be configured in a manner to hold the piston 360 in place during run-in, and at other times prior to setting. The trigger device 359 may be (including comparable to) like that of a shape memory alloy device, such as described on the URL https://tiniaerospace.com/products/space-frangibolt/. The trigger device 359 may be or include a switch, a solenoid, a dog/collet, or other suitable device for maintaining the piston 360 in a first position until it is desired to set the downhole tool 302.

An activation event may activate the trigger device 359, such as the aforementioned signal transfer. Upon activation, the trigger device 359 may undergo an altering event or change of state, such as a portion thereof changing from a first position to a second position. As shown in FIGS. 3A and 3B, an elongated stem 359*a* of the device 359 may be reduced to a shortened stem 359*b*. This change may be from, for example, melting or fracturing. However, the trigger device 359 and change of state are not meant to be limited, and other components or configurations may be used for the activation event, particularly anything that may facilitate the piston 360 may be moved by wellbore fluid (pressure) Fw, and the flow path(s) 366, 366*a*, 366*b*, etc. opened.

Initially (and prior to the activation event) the trigger device 359 may be configured to hold the piston 360 in place in a first piston position, despite the presence of the wellbore fluid Fw acting thereon. The wellbore fluid may act on the piston 360 via an opening or upper housing side port 397. To prevent debris and the like from blocking the port 397, there may be a screen or mesh 343 disposed around the upper housing 357. The screen 343 may be placed therearound during assembly.

Once the piston 360 is moved from its initial or first position, the wellbore fluid Fw may flow through the flow path(s) and act on any pressure chamber piston area (or working surface area) encountered. Although not limited to any particular shape or size, the working (movable) surface may have a surface area of any given stage may be in a range of about 4 square inches to about 7 square inches. In embodiments, the surface area may be about 5 square inches. For more setting force (such as for low wellbore pressure), more surface area (and thus more stages) may be used.

Ultimately the pressure within the chamber(s) may increase (sometimes rapidly or nearly instantaneously) to a first preliminary or pre-determined (or also first actuation) force that frees (or disengages) the first stage housing 376 from the inner housing 357. This first pre-determined force may be in the range of about 4,000 to about 8,000 lbs force. The first pre-determined force may be tantamount to an amount of pressure within the chambers (e.g., 382, 384, 386) times the cumulative working surface area within those chambers (e.g., 383, 385, 387). The amount of force may be determined from the wellbore pressure and the cumulative amount of working surface area within the setting tool 317.

It may be desirous to have the first pre-determined force be at least about 4,000 lbs in order to protect against inadvertent separation of components of the setting tool 317 during run-in. On the other hand, too high of an activation force may result in reduced time to properly set the downhole tool 302.

Once the first pre-determined force is exceeded, the shear screws 392 may shear, and the housings (e.g., 376, 378, 380, 381) may now be free to move/slide. Continuing of the increase or buildup in pressure within the chambers ultimately results in the setting sleeve 354 being urged more and more against the downhole tool 302 (such as described herein), and thus starting the setting sequence for the tool 302.

The upper housing 357 may have an outer surface 357*b*, which may be suitable for the first stage housing 376 to slidingly engage therewith. Thus, the first stage housing 376 may be of a shape suitable to cooperate with the upper housing 357, such as cylindrical.

The first stage housing 376 may be initially coupled with the upper housing 357 via the screw(s) 392 (via insertion and tightening through screw bore 393). In embodiments, the first stage housing 376 may include a sleeve collar 340. The screws 392 may thus be inserted within the sleeve collar 340. Once the break point of the screw(s) 392 (or other suitable hold mechanism) is overcome, the housings 376, 378, 380, 381 may be movable. To aid sealing engagement, there may be one or more orings 394 disposed between various component surfaces. Any orings may be sealingly disposed within a respective oring recess 394*a*, as would be apparent to one of skill in the art. Not all orings or oring grooves are shown in detail, and other configurations are possible.

Figure 3F:
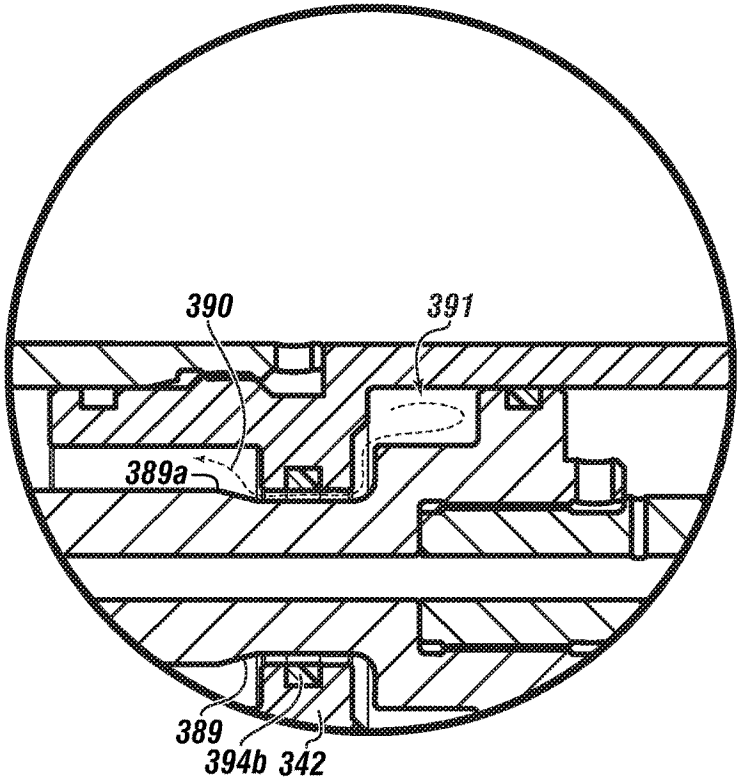
FIG. 3F shows a zoom-in view of a pressure equalization flowpath for the setting tool of FIG. 3A according to embodiments of the disclosure.

At the point of assembly, any or each housing may have an inner shoulder 342 sealingly engaged with its proximate respective mandrel. For example, first stage housing 376 may have the inner shoulder 342 sealingly and movingly engaged with the first stage mandrel 377. As the housing 376 moves, the shoulder 342 will move, and will ultimately come radially proximate to a pressure equalization groove 389 (comparable grooves 389*a*, 389*b*). Once this point is reached, the equalization chamber 391 will be in fluid communication with first pressure chamber 382. As such, the pressure in each of the chambers may equalize. Briefly, FIG. 3F shows shoulder 342 radially proximate to the groove 389, whereby a flowpath 390 is created to allow pressure equalization of the setting tool 317 with the surrounding wellbore.

The shoulder may have a shoulder recess 338 configured to accommodate the shoulder 342 coming to rest on mandrel shoulder 339. When this point is reached (equivalent to total stroke St—see FIG. 3C), the housing(s) cannot move any further.

The upper housing 357 may include a lower elongated end 357*c* coupled with the first stage mandrel 377. The coupling may be threaded engagement. The lower end 357*c* may have a fluid port 395, whereby the housing 357 and the first stage mandrel 377 may have fluid communication therebetween. For example, the lower end fluid port 395 may align with a first stage fluid passage 377*a*. The first stage 377 may also have a first side port 388, and as such there may be fluid communication between the housing 357 and the first pressure chamber 382 (and components therebetween). When the piston 360 is in the first position, however, the first pressure chamber 382 (or other chambers) will not be in fluid communication with wellbore (not accounting for negligible seepage, leakage, etc.).

As may be desired, the first stage fluid passage 377*a* may extend through the entire (longitudinal) length of the first stage mandrel 377. As such, the first stage fluid passage 377*a* may also align with a second stage fluid passage 379*a* of the second stage mandrel 379. One of skill would appreciate that the housing 357 may thus be in fluid communication with the second pressure chamber 384 (via a second side port 388*a*).

In a similar manner, the second stage fluid passage 379*a* may extend through the entire length of the second stage mandrel 379. As such, the second stage fluid passage 379*a* may also align with a third or tension mandrel passage 316*a*. One of skill would similarly appreciate that the housing 357 may thus be in fluid communication with the third pressure chamber 386 (via a third side port 388*b*).

The tool 317 may be configured with additional stages (not shown here), any of which may be in fluid communication with the housing 357, and as such wellbore fluid (pressure) may interact with any respective surfaces being in such communication. As would be apparent, the housings 376, 378, 380, 381, and the setting sleeve adapter 374 (and setting sleeve 354) may each be securely engaged together, yet slidingly moveable with respect to the inner housing 357 and mandrels 377, 379, 316.

At run-in, the setting tool 317 may be at its pre-set or beginning (or first) position as shown by indicator line Sb. During setting, the housings may move a first distance 399 equivalent to an effective stroke length Se. To reach the effective stroke Se, the fluid communication (of fluid Fw) may be established between the wellbore (208) and any pressure chamber within the setting tool 317.

In embodiments, the fluid communication may be dramatic and instantaneous to the point that dampening may be provided between the components, thus alleviating or mitigating impact forces therebetween. This may be especially critical at the point where the setting tool 317 is disconnected from the downhole tool 302, and resistance against impact is reduced.

FIG. 3A illustrates the position of the of the setting tool 317 in its pre-stroke position—see lateral reference line Sb. One of skill would appreciate that other points of reference may be used. The pre-stroke position Sb (for Stroke-begin) may refer to any time up and until the first pre-determined (or actuation) force is achieved, such that the housing(s) 376 et al. have not moved. Once the activation event occurs, the piston 360 may move, and fluid pressure of fluid Fw may enter the tool 317.

Figure 3E:
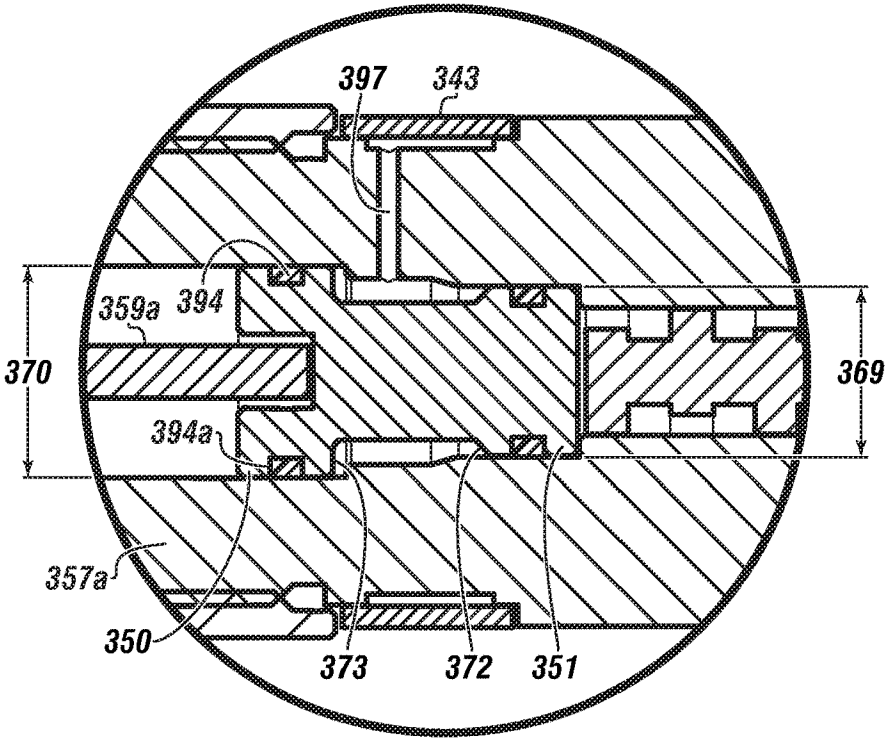
FIG. 3E shows a zoom-in view of a movable piston coupled with a trigger device within the setting tool of FIG. 3A and according to embodiments of the disclosure.

Referring briefly to FIG. 3E, this piston 360, while not limited to any particular shape or configuration may be generally cylindrical. The piston 360 may be movingly and sealingly engaged with the piston bore-side surfaces of the upper housing 357 (see oring 394 and oring groove 394*a*). In its initial position and during run-in, the piston 360 may be in the position shown in FIG. 3E. In the wellbore, pressure of the wellbore fluid (Fw) may be felt on working surfaces 373 and 372.

While not limited, the upper working surface 373 may have a respective surface area of about 1 square inch to about 1.5 square inches. In an analogous manner, the lower working surface 372 may have a respective surface area of about 0.5 square inches to about 1 square inch. The ratio between the upper:lower surface areas may be in a range of about 1.01:1 to about 1.4:1.

In order to facilitate movement of the piston 360 in a certain direction (in order to open flow paths 366, etc. to the wellbore), the upper working surface 373 may be larger than the lower working surface area 372. While not limited to any particular size, the surfaces 373, 372 may have a surface area ratio range of 1.1:1 to 1.4:1. This means the working surface area 373 may be about 1.1 to about 1.4 times bigger than the working surface area 372.

As such the piston 360 may be configured in a manner to have a varied or dual outer diameter. For example, a lower piston end 351 may have a lower piston outer diameter 369, and the upper piston end 350 may have an upper piston outer diameter 370. As seen here the upper piston outer diameter 370 may be larger than the lower piston outer diameter 369, which may accommodate the sizing of the working surface area 373 being respectively larger than 372.

To prevent movement of the piston 360, the trigger device 359 may be configured to hold the piston 360 in place. For example, stem 359*a* may be of suitable strength in order to hold the piston 360 in place, even in the presence of pressure from the wellbore fluid Fw. Once the trigger device 359 undergoes activation, the stem 359*a* may undergo a change of state (such as breaking, melting, dissolving, etc.) in whatever manner desired whereby the piston 360 may now be moved to its second position (see FIG. 3B).

Once the piston 360 is moved, pressure may now begin to build in chambers 382, 384, 386, and act on respective chamber working surfaces 383, 385, 387. The force exerted on the working surface(s) may correspondingly increase. The movant force may eventually exceed that of a first pre-determined force (as predetermined by shear screw(s) 392), such that the screw(s) 392 may shear, and the housing(s) 376 may slide freely along surface 357*b*. In embodiments, there may be about three shear screws, each with a pre-determined shear point of about 2000 lbs. (about 6,000 lbs [shear] force total). In embodiments, the first predetermined force may be in a range of about 4,000 lbs force to about 8,000 lbs force.

A second predetermined point may be completion of the setting sequence of the downhole tool. The downhole may be set in a setting force range of about 10,000 lbf to about 40,000 lbf. A third predetermined point may be completion of disconnect. The disconnect of the setting tool assembly from the downhole tool may be in the range of about 20,000 lbf to about 55,000 lbf.

In order to prevent undesired jarring, the setting tool may be configured with a tortuous flowpath within the upper housing 357. The flowpath may slow or otherwise hinder the flow of fluid into the setting tool 317. While shown here as an insert 365, the housing 357 may just as well have an integral flowpath therein. And although a rod/baffle/channel configuration is shown, other configurations are possible, such as a helical winding and the like.

As the setting sleeve adapter 374 may be engaged with the setting sleeve 354, ultimately the setting sleeve 354 may be urged against the downhole tool (302, FIG. 3B—shown in part) in order to initiate and complete a respective sequence as related to setting and disconnect (such as described herein for downhole tool 202/302).

To alleviate potential pressure buildup from or against the downhole tool 302, there may be a relief flow path. As shown in part, the relief flow path may be through an adapter bore 353, to a front port or opening (of the tension mandrel), a side outlet, to a setting sleeve port 355, into an annulus (not shown here). This provides the assembly 317 with the ability to equalize pressure on top of a seated ball 358.

Between beginning stroke Sb and total stroke St, the assembly 317 may have a second or intermediate position where the assembly may have resultantly initiated (and in some instances completed) setting of the downhole tool 302. An intermediate position may refer to any position between the pre-stroke Sb and effective stroke Se position. One of skill would appreciate various components have the assembly 317 may move a distance equivalent with respect to distance 399, which may be the distance to move to the effective stroke position Se.

The intermediate position may include the effective stroke Se of the tool 317, which may be contemplated as the point of where the oring 394*b* is immediately adjacent an outermost edge (or corner) 389*a* of the inner groove 389. The intermediate position may be the point where the downhole tool 302 has been set or a point within the setting process (such as pertaining to the breaking of a first slip and/or a second slip). The intermediate position may be the point where the downhole tool 302 has been separated from the setting tool assembly 317. In this respect, by the time the effective stroke Se of the tool 317 is reached, the downhole tool 302 may be set and disconnected.

As the pressure builds within the chambers 382/384/386, it may continue to act on the working surface area(s) within respective chambers, as about 20,000 to about 55,000 lbsf may be needed for setting and disconnect, depending on downhole conditions. In other words, in the setting sequence, about 20,000 lbs force to about 55,000 lbs force may be required for setting, and to ultimately disconnect the setting tool 378 from the downhole tool 302 (typically via shearing of threads of the mandrel 314). One of skill would appreciate setting occurs before disconnect.

The intermediate position may be contemplated as including the point of being just before pressure equalization occurs between chambers. In this respect the assembly 317 need not have any liquid dampening, nor does the assembly 317 require any kind of additional liquid dampening chamber. Moreover, the setting tool assembly 317 need not require any kind of power charge.

It may be that once the oring 394*b* moves passed the outermost edge of the groove 389*a*, the pressure between chambers (e.g., first chamber 382 and respective equalization chamber 391) may immediately equalize. Thus, the total stroke St [or Stroke-total] may have a total stroke length that includes the effective stroke plus the dampening stroke.

For the oring 394*b* to reach the edge 389*a*, the setting tool assembly may undergo a stroke distance of at least four inches. In embodiments, this stroke distance may be about 4 inches to about 6 inches.

FIG. 3C represents the setting tool 378 in a full- or total stroke position St. It may be contemplated that the equalization chamber would be less than 4 inches in order to provide the benefit of an overall shorter length of the setting tool assembly 317. Thus, it is likewise contemplated that the total stroke St of the setting tool assembly 317 would be less than or equal to about 10 inches. In embodiments, the total stroke length St may be about 6 inches. In embodiments the maximum total stroke length St may be about 5 to about 10 inches.

Put another way, a respective stage 367, 368 may have adequate length and configuration accommodate movement of components to accommodate the tool assembly reaching total stroke St, with the tool 302 set, and the assembly 317 disconnected therefrom.

Referring now to FIGS. 4A and 4B together, an isometric view and a longitudinal cross-sectional view, respectively, of a head adapter usable with a setting tool assembly in accordance with embodiments disclosed herein, are shown.

Embodiments herein apply to a head adapter associated with operable systems, subsystems, assemblies, modules, skids, and so forth, including those described herein. The adapter 471 may be part of an overall setting tool assembly, such as assembly 317. While it need not be exactly the same, the adapter 471 may include various features and components like that of adapter 371, and thus components thereof may be duplicate or analogous.

While not limited to any particular shape, the head adapter 471 may be an elongated member of any suitable shape, such as generally cylindrical or comparable. The adapter 471 may be made of any material known for durability in wellbore operations, such as cast iron or steel. The adapter 471 may have be an upper end 437 (which may be adaptable to attach with a portion of a workstring—not shown here).

The adapter 471 may be configured for threadingly attaching to another threaded member via threads 436*a*. Threads include stub acme, buttress, and the like. The adapter 471 may have an inner bore 471 for which a trigger mechanism and piston may be disposed therein. The adapter 471 may be configured to couple with an upper housing (not shown here).

Referring now to FIGS. 5A and 5B together, an isometric view and a longitudinal cross-sectional view, respectively, of an upper (inner) housing usable with a setting tool assembly in accordance with embodiments disclosed herein, are shown.

Embodiments herein apply to an upper housing associated with operable systems, subsystems, assemblies, modules, skids, and so forth, including those described herein. The upper housing 557 may be part of an overall setting tool assembly, such as assembly 378. While it need not be exactly the same, the upper housing 557 may include various features and components like that of housing 357, and thus components thereof may be duplicate or analogous.

The upper housing may be a durable member of any suitable shape, such as generally cylindrical or comparable. The housing 557 may be made of any material known for durability in wellbore operations, such as cast iron or steel. The housing may have an upper housing end 557*a* configured for coupling with an adapter housing (not shown here) as described herein, such as threaded.

The housing may have an inner annular bore, which may be configured to be used for one or more components to be disposed therein. For example, there may be a piston bore 563 configured for a piston (not shown here) to be disposed therein, and there may be an insert bore 564 configured for an insert (not shown here) to be disposed therein.

The housing 557 may be configured for coupling (such as threadingly) to another component, such as with a head adapter, setting sleeve adapter, or another housing, including as described herein. In addition to threads, one or more set screws or other retainer mechanism may be screwed into recess region(s) 562. To aid sealing engagement, there may be one or more orings disposed between proximate surfaces, such as within oring recess(es) 594*a*, as would be apparent to one of skill in the art.

To facilitate fluid communication (via flowpath 566), there may be one or more fluid ports, such as side port 597 and lower port 595. One of skill would appreciate there may be a plurality of side ports and/or lower ports.

Figure 6:
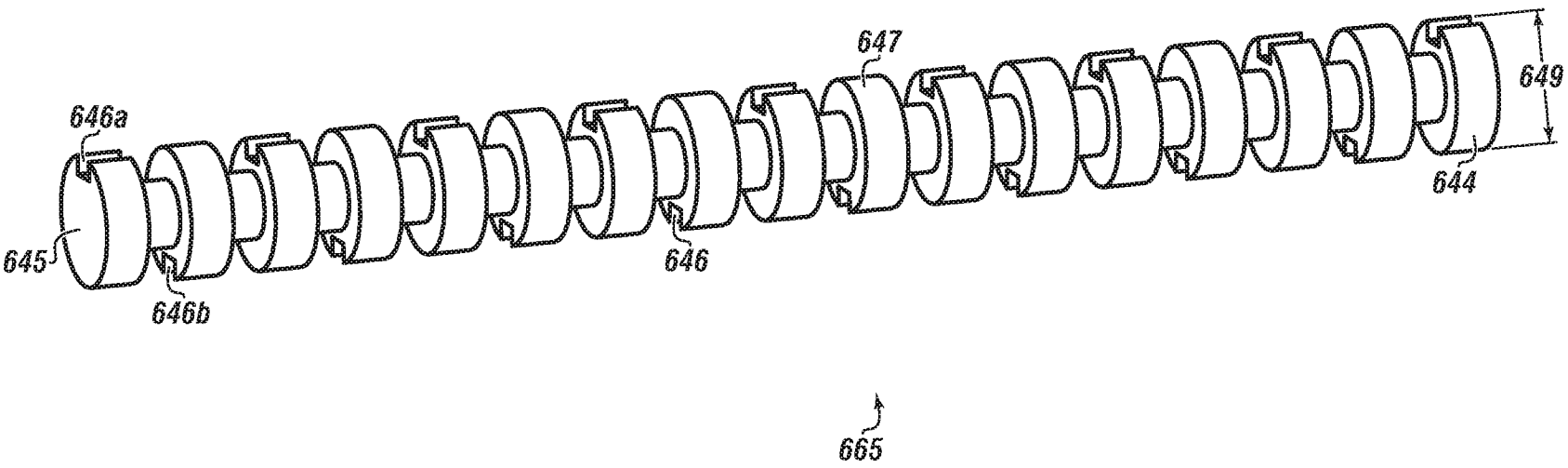
FIG. 6 shows an isometric view of a restrictor insert according to embodiments of the disclosure.

Referring now to FIG. 6, an isometric view an insert usable with a setting tool assembly in accordance with embodiments disclosed herein, is shown.

Embodiments herein apply to a restrictor or insert associated with operable systems, subsystems, assemblies, modules, skids, and so forth, including those described herein. The insert 665 may be part of an overall setting tool assembly, such as assembly (317). While it need not be exactly the same, the tension mandrel 616 may include various features and components like that of tension mandrel 316, and thus components thereof may be duplicate or analogous.

The insert 665 may be configured in a manner to restrict or limit rapid flow of wellbore fluid into the setting tool (317). As shown here, the insert 665 may be an elongated member of any suitable shape to reside within a bore, and thus have a desired outer diameter 659. As shown here, the insert may be a generally cylindrical rod 645 configured with a plurality of baffles 647. The baffles 647 are not limited, and any also be any suitable shape. Here, the baffles 647 are shown as cylindrical members extending radially from the rod 645. Other fin-type shapes are possible, such as helically wound vane(s). The rod 645 may have internal channels formed therein (not shown here).

The outer edges/surfaces 648 of any respective baffle may have a channel 646 formed therein. The channels 646 may be longitudinal in nature whereby fluid may pass thereby in order to move to the next channel, and so forth. The channels may have an alternating or offset configuration (see 646*a* and 646*b*). The alternating or offset between adjacent channels may be in an offset range of about 1 degree to about 180 degrees.

Referring now to FIGS. 7A and 7B together, an isometric view and a longitudinal cross-sectional view, respectively, of a tension mandrel usable with a setting tool assembly in accordance with embodiments disclosed herein, are shown.

Embodiments herein apply to a tension mandrel associated with operable systems, subsystems, assemblies, modules, skids, and so forth, including those described herein. The tension mandrel 716 may be part of an overall setting tool assembly, such as assembly 317. While it need not be exactly the same, the tension mandrel 716 may include various features and components like that of tension mandrel 316, and thus components thereof may be duplicate or analogous.

The tension mandrel 716 may be of any suitable shape, such as generally cylindrical or comparable. The tension mandrel 716 may be made of any material known for durability in wellbore operations, such as cast iron or steel. The tension mandrel 716 may have an upper mandrel end 720 configured for coupling with a lower end of a stage housing (not shown here). The coupling may be securable, such as via threaded and/or use of set screws. Thus, the upper end may have an inner mandrel thread profile. The upper end 720 may have a receptacle to which a set screw or the like may be inserted.

For completing a flowpath to a pressure chamber, the tension mandrel may have a first bore 716*a* which may be in fluid communication with said pressure chamber. There may be a side port 788*b* therebetween. There may be an equalization groove 789 formed thereon. The body of the mandrel 716 may have a radial shoulder 742. The shoulder 742 may be configured with a groove 794*a* (for an oring).

The tension mandrel 716 may have a lower end 721 configured for coupling with another component, such as an adapter (352). The lower end 721 of the tension mandrel 716 may have an end port or opening 793, as well as a side outlet(s) (not shown here), which may provide pressure equalization with the associated downhole tool (not shown here).

The mandrel 716 may have an outer surface thereof that may be configured for sliding engagement with a surrounding tubular/housing (not shown here). The mandrel 716 may be configured for threadingly attaching to another threaded member via threads, such as with a universal coupling adapter (which may then connect with a downhole tool). Threads include stub acme, buttress, and the like. In addition to threads, one or more set screws or other retainer mechanism may be screwed into recess region(s). To aid sealing engagement, there may be one or more orings disposed between proximate surfaces, such as within oring recess(es) 794*a*, as would be apparent to one of skill in the art.

Referring now to FIGS. 8A and 8B together, an isometric view and a longitudinal cross-sectional view, respectively, of a stage mandrel usable with a setting tool assembly in accordance with embodiments disclosed herein, are shown.

Embodiments herein apply to a stage mandrel associated with operable systems, subsystems, assemblies, modules, skids, and so forth, including those described herein. The stage mandrel 877 may be part of an overall setting tool assembly, such as assembly 317. While it need not be exactly the same, the stage mandrel 877 may include various features and components like that of other stage mandrels described herein, and thus components thereof may be duplicate or analogous. There may be multiple stage mandrels 877, such as a first stage mandrel, second stage mandrel, third stage mandrel, and so forth. The stage mandrels need not be exact.

The stage mandrel 877 may be of any suitable shape, such as generally cylindrical or comparable. The stage mandrel 877 may be made of any material known for durability in wellbore operations, such as cast iron or steel. The stage mandrel 877 may have an upper stage mandrel end 819 configured for coupling with a lower end of a stage housing (not shown here) or other housing, such as an upper housing (FIG. 3A, 357). The coupling may be securable, such as via threaded and/or use of set screws. Thus, the upper end 819 may have a mandrel thread profile. The upper end 819 may have a receptacle to which a set screw or the like may be inserted.

For completing a flowpath to a pressure chamber, the stage mandrel may have a first bore 877*a* which may be in fluid communication with said pressure chamber. There may be a side port 888 therebetween. To communicate fluid to another stage mandrel, the bore 877*a* may extend completely in longitudinal length through the body of the mandrel 877. The lower end 818 of the mandrel 877 may be configured to accommodate and couple with a subsequent upper end of a next stage mandrel.

There may be an equalization groove 889 formed thereon (with discernable corner or edge 889*a*). The body of the stage mandrel 877 may have a radial shoulder 742, as well as a second radial shoulder 842*a*. Either of the shoulders 842, 842*a* may be configured with a groove 794*a* (for an oring). The shoulder 842*a* may be movingly engaged with a surrounding housing (e.g., the housing can slidingly move against the shoulder 842*a*, etc.)

The stage mandrel 877 may have a lower end 818 configured for coupling with another component, such as another mandrel (stage, tension, etc.). The mandrel 877 may have an outer surface thereof that may be configured for sliding engagement with a surrounding tubular/housing (not shown here). The mandrel 877 may be configured for threadingly attaching to another threaded member via threads, such as with a universal coupling adapter (which may then connect with a downhole tool). Threads include stub acme, buttress, and the like. In addition to threads, one or more set screws or other retainer mechanism may be screwed into recess region(s). To aid sealing engagement, there may be one or more orings disposed between proximate surfaces, such as within oring recess(es) 894*a*, as would be apparent to one of skill in the art.

Advantages

Of significance, embodiments herein provide for a setting tool that does not require or is void of a liquid timer/shock absorber built in feature. Conventional setting tools, such as the Baker, require oil to move from one chamber to a second chamber through a small orifice as it pertains to the setting time. The setting tool of the disclosure does not require any liquid displacement for timing/shock absorbing purposes.

Embodiments herein also alleviate need for a power charge. Without need for liquid chambers or power charge chambers, the setting tool may beneficially shorter. A shorter setting tool can easily pass through tight wellbore doglegs. A smaller number of parts and elimination of liquids required for the setting tool to operate properly increase tool reliability. Without an explosive power charge, the setting tool is inherently safer. No special licenses required to operate the setting tool and transport explosives.

The setting tool can also be reset in the field without the need to be cleaned/redressed/rebuild.

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A method of using a setting tool assembly to set a downhole tool in a wellbore, the method comprising:

running a workstring into the wellbore to a desired location, the workstring comprising a lower end having the setting tool assembly coupled with the downhole tool, wherein the setting tool assembly further comprises:

a head adapter coupled with the workstring;

an upper housing coupled with the head adapter, and further having an inner housing piston bore and an inner housing insert bore;

a piston disposed within the inner housing piston bore;

an insert disposed within the inner housing insert bore;

a trigger device disposed within the head adapter, wherein the trigger device is operably configured to receive an activation signal, and wherein the trigger device is configured to hold the piston in a first position, and facilitate movement of the piston to a second position after receiving the activation signal;

a first stage housing releasably coupled with the upper housing;

a first stage mandrel disposed within the first stage housing, and coupled with the upper housing, and wherein a first pressure chamber is formed between the first stage housing and the first stage mandrel;

a setting sleeve adapter having a first end coupled with the first stage mandrel, a second end coupled with a setting sleeve, wherein the setting sleeve adapter is movingly disposed around the first stage mandrel;

causing the activation signal to transmit in a manner to activate the trigger device, whereby the piston is subsequently moved to the second position as a result of fluid pressure from a wellbore fluid acting thereon, and wherein fluid pressure also then enters the first pressure chamber, wherein the piston comprises a first working surface having a first surface area, and a second working surface having a second surface area, wherein a surface ratio of the first surface area to the second surface area is in a surface area range of 1.1:1 to 1.4:1, wherein the setting tool comprises a total stroke distance of at least 7 inches to no more than 10 inches, wherein the first stage housing is releasably coupled to the inner housing with one or more shearing devices, and wherein the one or more shearing devices shear in a range of 4000 lbf to 8000 lbf, and upon release, thereafter the downhole tool begins to set.

2. The method of claim 1, wherein the setting tool further comprises an effective stroke distance of at least 4 inches to no more than 6.5 inches.

3. The method of claim 1, wherein the first pressure chamber is not in fluid communication with the wellbore when the piston is in the first position, and wherein the first pressure chamber is in fluid communication with the wellbore when the piston is in the second position.

4. The method of claim 1, wherein the insert comprises a plurality of channels configured to create a tortuous path for the wellbore fluid flowing thereby.

5. The method of claim 4, wherein the first stage housing comprises a first inner shoulder movingly and sealingly engaged with the first mandrel, and wherein after the downhole tool is set, the first inner shoulder is radially proximate an equalization groove formed in the first mandrel.

6. The method of claim 4, wherein the first stage housing comprises a first stage working surface having a first stage working surface area in a range of four square inches to six square inches.

7. A setting tool assembly for setting a downhole tool, the setting tool assembly comprising:

an adapter housing configured for coupling the setting tool assembly with a workstring;

an upper housing coupled with the adapter housing, and further having an inner housing piston bore;

a piston disposed within the inner housing piston bore;

a trigger device disposed within the adapter housing, wherein the trigger device is operably configured to receive an activation signal, and wherein the trigger device is configured to hold the piston in a first position, and facilitate movement of the piston to a second position after receiving the activation signal;

a first stage housing releasably coupled with the upper housing;

a first stage mandrel disposed within the first stage housing, and coupled with the upper housing, and wherein a first pressure chamber is formed between the first stage housing and the first stage mandrel;

an insert disposed within the upper housing, the insert comprising an elongated member configured with a plurality of baffles thereon, with each of the plurality of baffles configured with an at least one respective channel formed therein a setting sleeve adapter having a first end coupled with the first stage mandrel, wherein the setting sleeve adapter is movingly disposed around the first stage mandrel.

8. The setting tool of claim 7, wherein the piston comprises a first working surface having a first surface area, and a second working surface having a second surface area, wherein a surface ratio of the first surface area to the second surface area is in a surface area range of 1.1:1 to 1.4:1.

9. The setting tool of claim 8, wherein the setting tool further comprises a total stroke distance of at least 7 inches to no more than 10 inches, and an effective stroke distance of at least 4 inches to no less than 6.5 inches.

10. The setting tool of claim 9, wherein the first stage housing is releasably coupled to the upper housing with one or more shearing devices, and wherein the one or more shearing devices shear in a range of 4,000 lbf to 8,000 lbf.

11. The setting tool of claim 9, wherein the first stage housing comprises a first inner shoulder movingly and sealingly engaged with the first mandrel, and wherein the first inner shoulder is radially proximate an equalization groove formed in the first mandrel after the downhole tool is set.

12. The setting tool of claim 11, wherein the first stage housing comprises a first stage working surface having a working surface area in a range of four square inches to six square inches.

13. A method of using a setting tool assembly to set a downhole tool in a wellbore, the method comprising:

running a workstring into the wellbore to a desired location, the workstring comprising a lower end having a setting tool assembly coupled with the downhole tool, wherein the setting tool assembly further comprises:

a head adapter coupled with the workstring;

an upper housing coupled with the head adapter, and further having an inner housing piston bore and an inner housing insert bore;

a piston disposed within the inner housing piston bore;

an insert disposed within the inner housing insert bore;

a trigger device disposed within the head adapter, wherein the trigger device is operably configured to receive an activation signal, and wherein the trigger device is configured to hold the piston in a first position, and facilitate movement of the piston to a second position after receiving the activation signal;

a first stage housing releasably coupled with the upper housing;

a first stage mandrel disposed within the first stage housing, and coupled with the upper housing, and wherein a first pressure chamber is formed between the first stage housing and the first stage mandrel;

a setting sleeve adapter having a first end coupled with the first stage mandrel, a second end coupled with a setting sleeve, wherein the setting sleeve adapter is movingly disposed around the first stage mandrel;

causing the activation signal to transmit in a manner to activate the trigger device, whereby the piston is subsequently moved to the second position as a result of fluid pressure from a wellbore fluid acting thereon, and wherein fluid pressure also then enters the first pressure chamber, wherein the insert comprises a plurality of channels configured to create a tortuous path for the wellbore fluid flowing thereby.

14. The method of claim 13, wherein the piston comprises a first working surface having a first surface area, and a second working surface having a second surface area, wherein a surface ratio of the first surface area to the second surface area is in a surface area range of 1.1:1 to 1.4:1.

15. The method of claim 13, wherein the setting tool comprises a total stroke distance of at least 7 inches to no more than 10 inches.

16. The method of claim 13, wherein the first stage housing is releasably coupled to the inner housing with one or more shearing devices.

17. The method of claim 16, wherein the one or more shearing devices shear in a range of 4000 lbf to 8000 lbf, and upon release, thereafter the downhole tool begins to set.

* * * * *